US012252363B2

(12) United States Patent
Brettschneider

(10) Patent No.: US 12,252,363 B2
(45) Date of Patent: Mar. 18, 2025

(54) MECHANICAL TORQUE ACTIVATED CHUCK WITH MATERIAL PRESERVATION FEATURES

(71) Applicant: Reimund K Brettschneider, Marietta, GA (US)

(72) Inventor: Reimund K Brettschneider, Marietta, GA (US)

( * ) Notice: Subject to any disclaimer, the term of this patent is extended or adjusted under 35 U.S.C. 154(b) by 399 days.

(21) Appl. No.: 17/645,768

(22) Filed: Dec. 23, 2021

(65) Prior Publication Data

US 2023/0041506 A1 Feb. 9, 2023

Related U.S. Application Data

(60) Provisional application No. 63/230,342, filed on Aug. 6, 2021.

(51) Int. Cl.
*B65H 19/28* (2006.01)
*B65H 75/24* (2006.01)

(52) U.S. Cl.
CPC ..... *B65H 19/28* (2013.01); *B65H 75/246* (2013.01)

(58) Field of Classification Search
CPC .. B65H 75/185; B65H 75/242; B65H 75/246; B65H 75/247; B65H 75/249; B65H 18/10; B65H 18/02; B65H 16/02; B65H 16/103; B65H 16/04; B65H 2301/41461; B65H 2403/72; B65H 19/123; B65H 75/18; B65H 2301/41346
USPC ..... 242/571.6
See application file for complete search history.

(56) References Cited

U.S. PATENT DOCUMENTS 1,072,067 A * 9/1913 Wild ..... B65H 75/246 242/571.7
3,792,868 A * 2/1974 Flagg ..... B23B 31/1612 279/131
3,815,836 A * 6/1974 Munnekehoff ..... B65H 54/543 242/575.3
3,993,317 A * 11/1976 Flagg ..... B23B 31/16125 279/2.19

(Continued)

FOREIGN PATENT DOCUMENTS

CN 201338884 Y * 11/2009
CN 101830359 A * 9/2010

(Continued)

*Primary Examiner* — Michael R Mansen
*Assistant Examiner* — Henrix Soto
(74) *Attorney, Agent, or Firm* — Briggs Intellectual Prope; Jeremy A. Briggs

(57) ABSTRACT

A chuck includes a central shaft defining an axis of rotation, a cam seat defined by the central shaft, and a support portion partially defining a first cavity having a first orifice at a first distal end of the support portion, the first orifice operative to engage the central shaft. The support portion includes The chuck further comprises a second orifice defined by the support portion, an expansion portion arranged in the second orifice such that the expansion portion is operative to move radially in the second orifice with respect to the axis of rotation, and a follower member arranged in the cam seat. The expansion portion includes an arcuate profile comprising a core relief feature having a spacer member arranged on a portion of the support portion, the spacer member operative to impede motion of a core of a roll of material along the axis of rotation.

19 Claims, 27 Drawing Sheets

(56) References Cited

U.S. PATENT DOCUMENTS

| | | | | | |
|---|---|---|---|---|---|
| 4,334,652 | A * | 6/1982 | Blackburn | B65H 75/246 | 242/571.5 |
| 4,339,094 | A * | 7/1982 | Thievessen | B65H 75/246 | 279/2.2 |
| 4,635,872 | A * | 1/1987 | Thievessen | B65H 75/246 | 242/571.6 |
| 4,730,779 | A * | 3/1988 | Thievessen | B65H 16/04 | 242/596.7 |
| 4,911,376 | A * | 3/1990 | Thompson | B65H 75/2484 | 242/576.1 |
| 5,490,640 | A * | 2/1996 | Miller | B65H 75/246 | 279/2.24 |
| 2004/0256518 | A1* | 12/2004 | Hope | B65H 75/246 | 242/571 |
| 2005/0224627 | A1* | 10/2005 | Stolyar | B65H 16/06 | 242/571.6 |

FOREIGN PATENT DOCUMENTS

| | | | | |
|---|---|---|---|---|
| CN | 101831833 | A * | 9/2010 | |
| EP | 1090869 | A2 * | 4/2001 | B65H 75/246 |
| KR | 100897944 | B1 * | 5/2009 | |
| WO | WO-2019102343 | A1 * | 5/2019 | |

* cited by examiner

MECHANICAL TORQUE ACTIVATED CHUCK WITH MATERIAL PRESERVATION FEATURES

CROSS-REFERENCE TO RELATED APPLICATIONS

The present disclosure claims the benefit of priority to U.S. Provisional Patent Application 63/320,342, filed on Aug. 6, 2021.

TECHNICAL FIELD

The present disclosure relates to a mechanical torque activated chuck for the winding and unwinding of reels or rolls of deformable material or sheet material.

BACKGROUND

In the manufacturing, processing and handling of rolled sheet materials wound on a cylindrical core (referred to also as a winding tube, reel, core, spool, etc.), the material is unwound under controlled conditions of speed and tension of the material.

The material is wound onto a winding core, typically a cylindrical cardboard, plastic or metal tube with hollow distal ends, and to engage the winding core from two opposite sides by means of two mandrels supports. The mandrels support the core and the rolled material and transmit rotary moment or a braking moment to the reel winding, as well as desired displacement movements. To this end, the support spindles can in turn be connected to drive motors or braking systems that allow precise control of the speed and tension of the winding and unwinding of the material on the core when loaded in a machine that supplies the material to a manufacturing process.

There are known mechanical-pneumatic support spindles that can be inserted in the winding core and configured to assume a radially retracted configuration that torsionally disengages the winding core and allows the insertion and extraction of the mandrel in/from the winding core. These devices also radially expand to torsionally engage the winding core, where the retraction and expansion of the torque activated chuck can be operated by means of a special pneumatic drive system of the torque activated chuck, regardless of the interaction between the support spindle and the reel of wound material.

The torsional torque activated chucks of the prior art have the disadvantage that the core holding features (e.g., the locking bodies) that radially expand with torque to engage the core of the rolled material can also stress, deform, and sometimes tear the remaining rolled material when the roll is nearly (but not completely) depleted. The deformation of the edge of the material and core is due, in part, to outward radial force asserted by the locking bodies coupled with a diminishing holding power of the core and rolled material as the remaining material and core become increasingly deformable and unable to withstand the outward force exerted by the engagement surface. This effect can cause the outer edge of the remaining material to deform and tear due to the outward pressure. Small edge tears in the rolled material often run, causing the material to tear during the manufacturing process. Material that would have been usable becomes wasted when the machine operator replaces the nearly depleted material roll with a full roll. Accordingly, the machine operator must change rolls and waste the remaining rolled material.

The torsional engagement and disengagement with the winding core are positionally secured to the interior core using a plurality of locking bodies that are radially arranged on a support portion of a central shaft is not immediate and precisely coinciding with the application of a moment of winding the reel or with the application of a moment of release of the core, but dependent on a real rotary movement and therefore subject to unwanted slipping phenomena between the mandrel and the winding core and angular engagement/disengagement positions that cannot be controlled with certainty and repeatable results.

The need is therefore felt to have torsional support spindles with reduced angular actuation strokes (engagement/disengagement) with respect to the prior art, with a more immediate engagement and disengagement effect, and which are less subject to slipping unwanted during the engagement and disengagement of the winding core while avoiding pressure points on the core that can cause deformation and damage to the material edge of the rolled material as the roll is approaches complete unwinding.

It is with respect to these and other considerations that the disclosure made herein is presented.

SUMMARY

In embodiments a chuck includes a central shaft defining an axis of rotation, a cam seat defined by the central shaft, and a support portion partially defining a first cavity having a first orifice at a first distal end of the support portion, the first orifice operative to engage the central shaft. The chuck further comprises a second orifice defined by the support portion, an expansion portion arranged in the second orifice such that the expansion portion is operative to move radially in the second orifice with respect to the axis of rotation, and a follower member arranged in the cam seat.

In embodiments a chuck includes a central shaft defining an axis of rotation a cam seat defined by the central shaft, a support portion partially defining a first cavity having a first orifice at a first distal end of the support portion, the first orifice operative to engage the central shaft, and one or more spacer members arranged on a portion of the support portion providing a spacer member arranged on a portion of the support portion, the spacer member operative to create a gap between the winding core, the rolled material, and relieve axial forces of the chuck. The chuck further includes a second orifice defined by the support portion, an expansion portion arranged in the second orifice such that the expansion portion is operative to move radially in the second orifice with respect to the axis of rotation, and a follower member arranged in the cam seat.

In embodiments a chuck includes a central shaft defining an axis of rotation, a cam seat defined by the central shaft, a support portion partially defining a first cavity having a first orifice at a first distal end of the support portion, the first orifice operative to engage the central shaft, and a spacer member arranged on a portion of the support portion, the spacer member operative to impede motion of a core of a roll of material along the axis of rotation. The second orifice defined by the support portion, an expansion portion arranged in the second orifice such that the expansion portion is operative to move radially in the second orifice with respect to the axis of rotation, wherein the expansion portion has a first region having a first profile at a first distal end of the expansion portion, and a follower member arranged in the cam seat.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
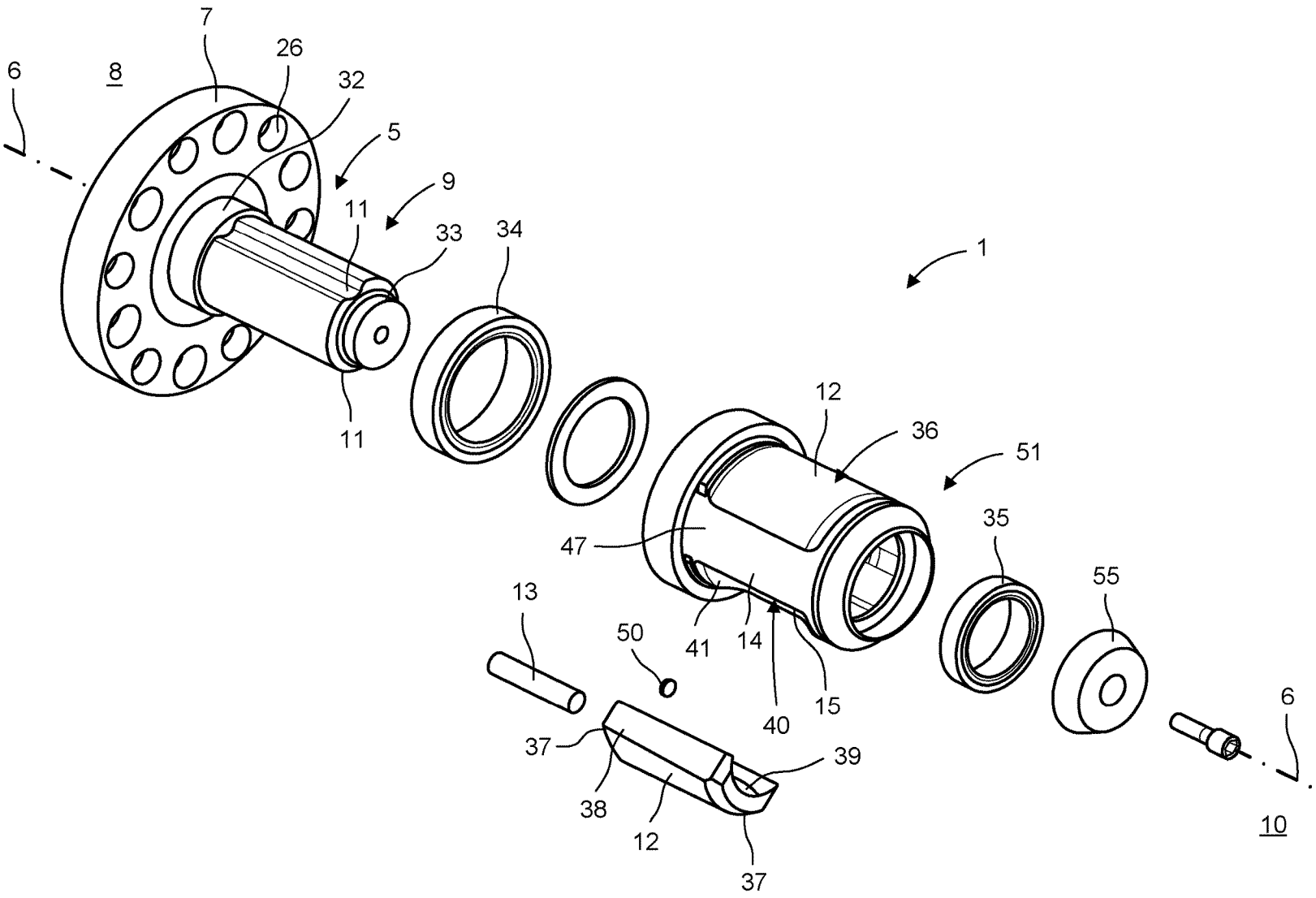
FIG. 1 is an exploded perspective view of a torque activated chuck in accordance with the present disclosure.

When material on a conventional winding core is nearly depleted, conventional systems lack the support and relief features to prevent torsional, axial, and other material-holding forces from damaging the remaining material on the spool. The need is therefore felt to have torsional support spindles with reduced angular actuation strokes (engagement/disengagement) with respect to the prior art, with a more immediate engagement and disengagement effect, and which are less subject to slipping unwanted during the engagement and disengagement of the winding core while avoiding pressure points on the core that can cause deformation and damage to the material edge of the rolled material as the roll is approaches complete unwinding.

Moreover, the need is therefore felt to have torsional support spindles that prevent contact of the material by the chuck while still supporting the core end.

The object of the present invention is therefore to provide a torque activated chuck for the winding and unwinding materials onto/from a tubular core, having characteristics that mitigate or eliminate at least some of the drawbacks mentioned with reference to known techniques.

A particular object of the present invention is to provide a torque activated chuck, having characteristics such as to further reduce the angular actuation strokes (engagement/disengagement) with respect to the prior art.

A further particular object of the present invention is to provide a torque activated chuck, having characteristics such as to carry out the engagement and disengagement with the winding core in a more immediate way in response to an entrainment of the core winding with respect to the torque activated chuck, and to reduce unwanted slipping during engagement and disengagement of the winding core.

Moreover, the need is therefore felt to have torsional support spindles with one or more spacer members arranged on a portion of the support portion that provides an extended lip and other features that prevent contact of the material by the chuck while still supporting the core end.

The object of the present invention is therefore to provide a torque activated chuck for the winding and unwinding materials onto/from a tubular core, having characteristics that mitigate or eliminate at least some of the drawbacks mentioned with reference to known techniques.

A particular object of the present invention is to provide a torque activated chuck, having characteristics such as to further reduce the angular actuation strokes (engagement/disengagement) with respect to the prior art.

A further particular object of the present invention is to provide a torque activated chuck, having characteristics such as to carry out the engagement and disengagement with the winding core in a more immediate way in response to an entrainment of the core winding with respect to the torque activated chuck, and to reduce unwanted slipping during engagement and disengagement of the winding core.

It is with respect to these and other considerations that the disclosure made herein is presented.

An improved mechanical torque activated adapter is described in accordance with embodiments of the present disclosure. The adapter may include a raised lip having a second diameter disposed on an external face that ensures axial contact from the chuck to the core only. The adapter lip comprises a diameter approximately equal or less than a core outside diameter such that the core may be positioned over the adapter without undue interference.

In embodiments, the raised diameter is disposed at one the end of the core insertion process to ensure contact to the core material only and avoid contact to the converting product. The length of the raised diameter may be configured to provide contact between chuck and core only and avoid and/or eliminate contact of the unwinding product to the chuck. The front of the chuck may further include a feature such as, for example, a taper, chamfer, an undulating profile, a concave profile, a convex profile, or an arcuate profile. configured to accommodate the insertion of the chuck into the core. The adapter is further configured with removable fastening means that rigidly secures a nose piece by a single screw or multiple screws depending on the machine requirements.

Once a product is loaded and the converting process begins a suitable device (such as a brake) will provide torque to the chuck flange. This torque will result in the holding the flange back while the adapter with the expansion units starts to rotate. This rotation is limited by the core inside diameter. Once the expansion units have contact with the core the proper force is applied to the roll product to allow controlled unwinding. The unique single roller design on the back of the expansion units allows the expansion units to self-position in a way that maximizes the contact to the core, resulting in an optimal web tension that holds the core and rolled material to the chuck without slippage and without undue deformation of the material and core. Moreover, embodiments of the present disclosure provide a unique internal mechanical chuck configured to allow secure core and material holding that requires minimal rotation before the expansion units engage with the core.

Improvements to conventional chucks disclosed herein include the following features that include the following features 1) n axial thrust bearing feature configured to avoid axial overload and ease of rotation at any time;

2) An improved bearing engagement angle that prevents chuck damage. More particularly, embodiments include a single tapered roller bearing disposed on a back surface, or according to a preferred embodiment, a front surface of the expansion units, where the expansion units are configured to allow for optimized expansion unit expansion and contraction from and to the core interior walls by means of, among other components, the single tapered roller bearing;
3) An optimized internal profile is configured to minimize rotation from neutral to a fully-engaged position that actuates the expansion units to their extended position; A chuck assembly 80 having a spacer member having an external second diameter that ensures contact by the chuck to the core without contacting the wound material. The raised lip 81 allows for the maximum use of the product wound on the core limiting the impact of axial load to the chuck;
4) A plurality of expansion units 12 configured with one or more features 37 that mitigate and/or eliminate pressure points on the material core. For example, embodiments of the present disclosure describe expansion unit features 37 having, for example, features 37 that provide an improved insertion of the shaft into the core, which may mitigate and/or eliminate radial overloading of the cores; and
5) A shaft and flange construction may use a continuous material, which increases rigidity and reliability of the expansion units and chuck holding capabilities. Some of the materials may include, for example, case hardened steel, steel, titanium or another suitable metallic material.

These and other advantages of the present disclosure are provided in greater detail herein.

The disclosure will be described more fully hereinafter with reference to the accompanying drawings, in which example embodiments of the disclosure are shown, and not intended to be limiting.

In the following description, the term "front" orientation refers to the orientation of sides, faces, surfaces, etc. in the direction of insertion of the torque activated chuck into a winding core, the term "rear" orientation refers to the orientation of sides, faces, surfaces, etc. in the direction of withdrawal of the torque activated chuck outside the winding core, unless otherwise specified. The terms "radial", "circumferential", "axial" refer to the longitudinal axis of the torque activated chuck which corresponds to the rotation axis of the torque activated chuck and the winding core engaged by it, unless otherwise specified. The terms medium, rolled product, or sheet product includes any material such as a sheet material that is rolled or coiled about a tubular core.

Figure 2:
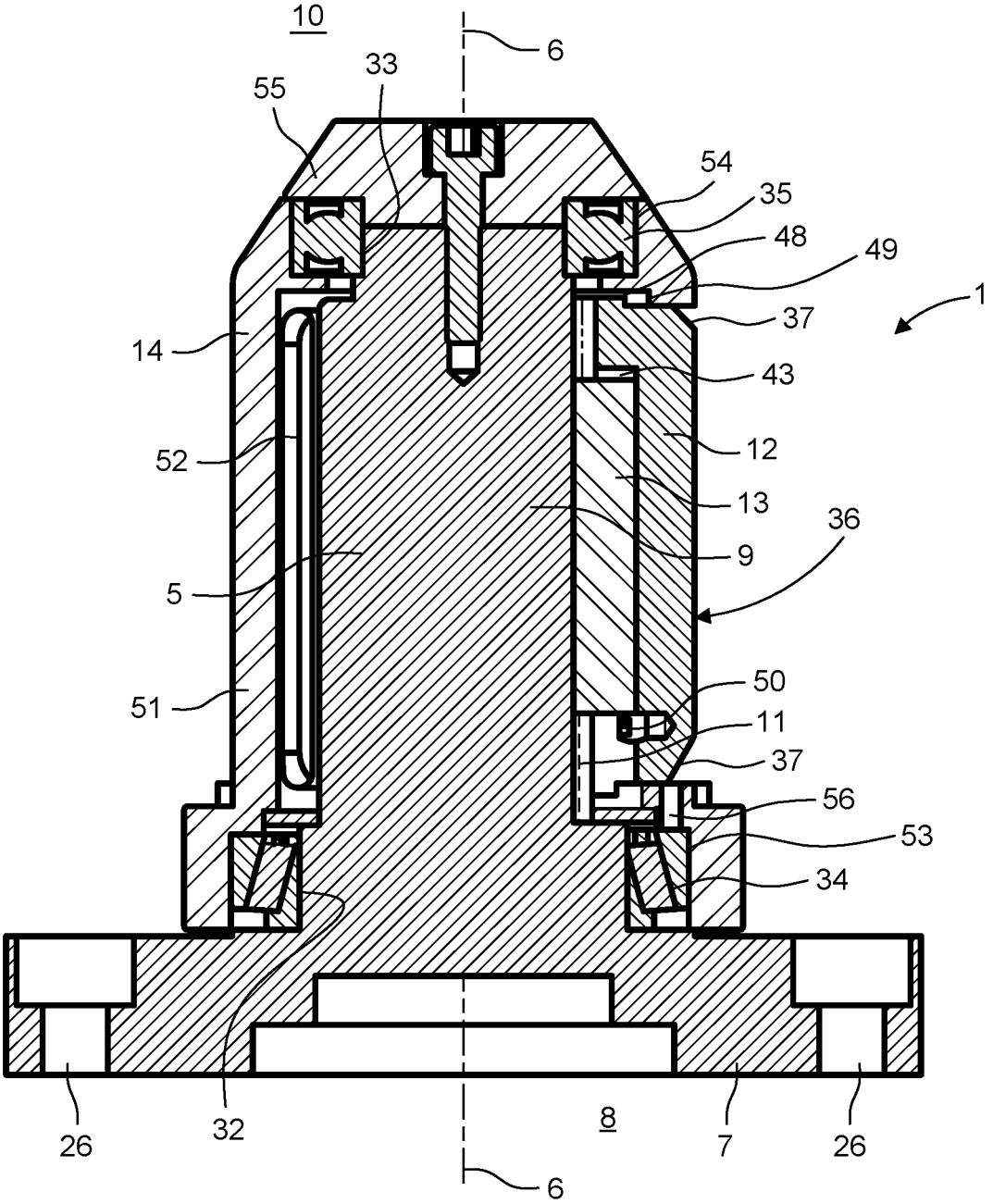
FIG. 2 is a sectional view in a radial plane of the torque activated chuck in FIG. 1 in accordance with the present disclosure.
Figure 12:
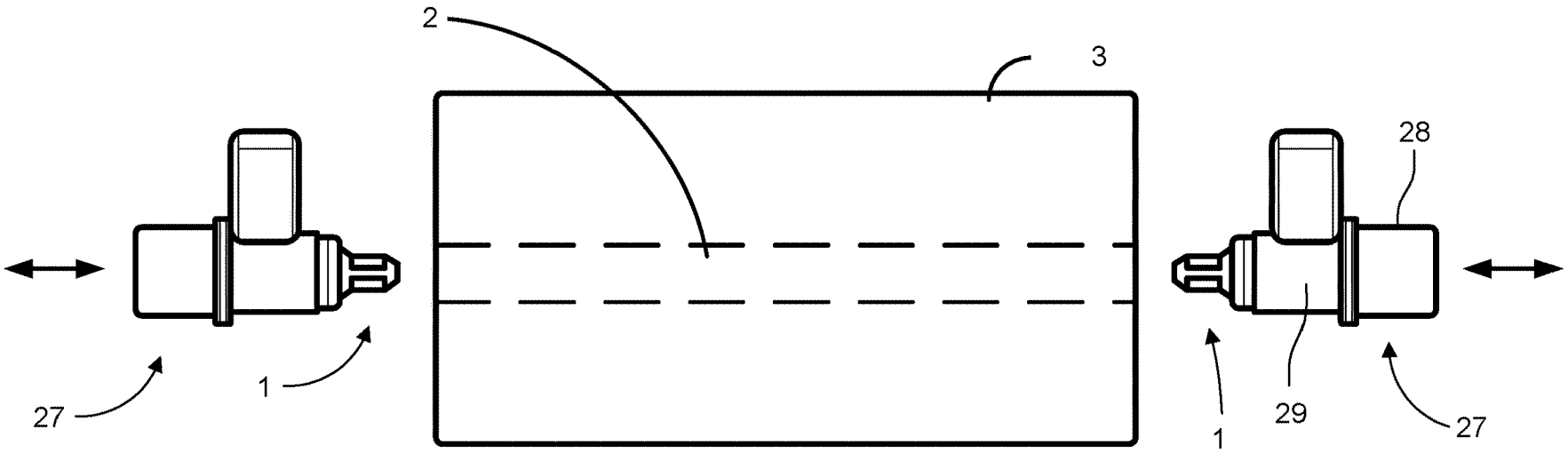
FIGS. 12 and 13 respectively illustrate two opposing torque activated chucks disengaged from (FIG. 12) and engaged with the winding core of a reel of roll-up material in accordance with the present disclosure.

FIG. 1 is an exploded perspective view of a torque activated chuck 1 in accordance with the present disclosure. The torque activated chuck 1 is arranged for engaging a tubular winding core 2 (FIG. 12) having open distal ends operative to engage the torque activated chuck 1 for winding and unwinding roll-up material 3 (FIG. 12) to form a coil 4 (FIG. 12). FIG. 2 illustrates a cut-away view partially defined by a plane intersecting the axis of rotation 6.

Referring first to FIG. 1, a central shaft 5 of the torque activated chuck 1 is illustrated defining a rotation axis 6. The central shaft 5 forms the following features that can include a connecting portion 7 on a rear side 8 of the torque activated chuck 1, a support portion 9 extended by the connecting portion 7 along the rotation axis 6 towards a front side 10 of the torque activated chuck 1, a plurality of cam seats 11 formed in the support portion 9, a plurality of expansion units 12 arranged radially outside the support portion 9 and in contact, via cam follower members 13, with the cam seats 11, and a support cage 14 connected to the central shaft 5 and forming a plurality of guide seats 15 which receive and position the locking bodies 12 so that the expansion units 12 can slide radially to the axis of rotation 6 with respect to the central shaft 5 and rotate about the rotation axis 6 with respect to the central shaft 5. The cam seats 11 and the cam follower members 13 are shaped in such a way that a relative rotation between the expansion units 12 and the central shaft 5 around the axis of rotation 6. The cam seats 11 and the cam follower members 13 may cause radial movement of the expansion units 12 between a retracted (end of stroke) position shown in FIG. 3 a cut-away view along the line III (shown hereafter in FIG. 4, which shows a side view of the torque activated chuck 1). FIG. 5 illustrates another cut-away view along the line V of FIG. 6, radially internal, and an expanded (end of stroke) position (FIG. 5), radially external, for disengagement and engagement of the torque activated chuck 1 (FIG. 12) with the core of winding 2 (FIG. 12).

Figure 7:
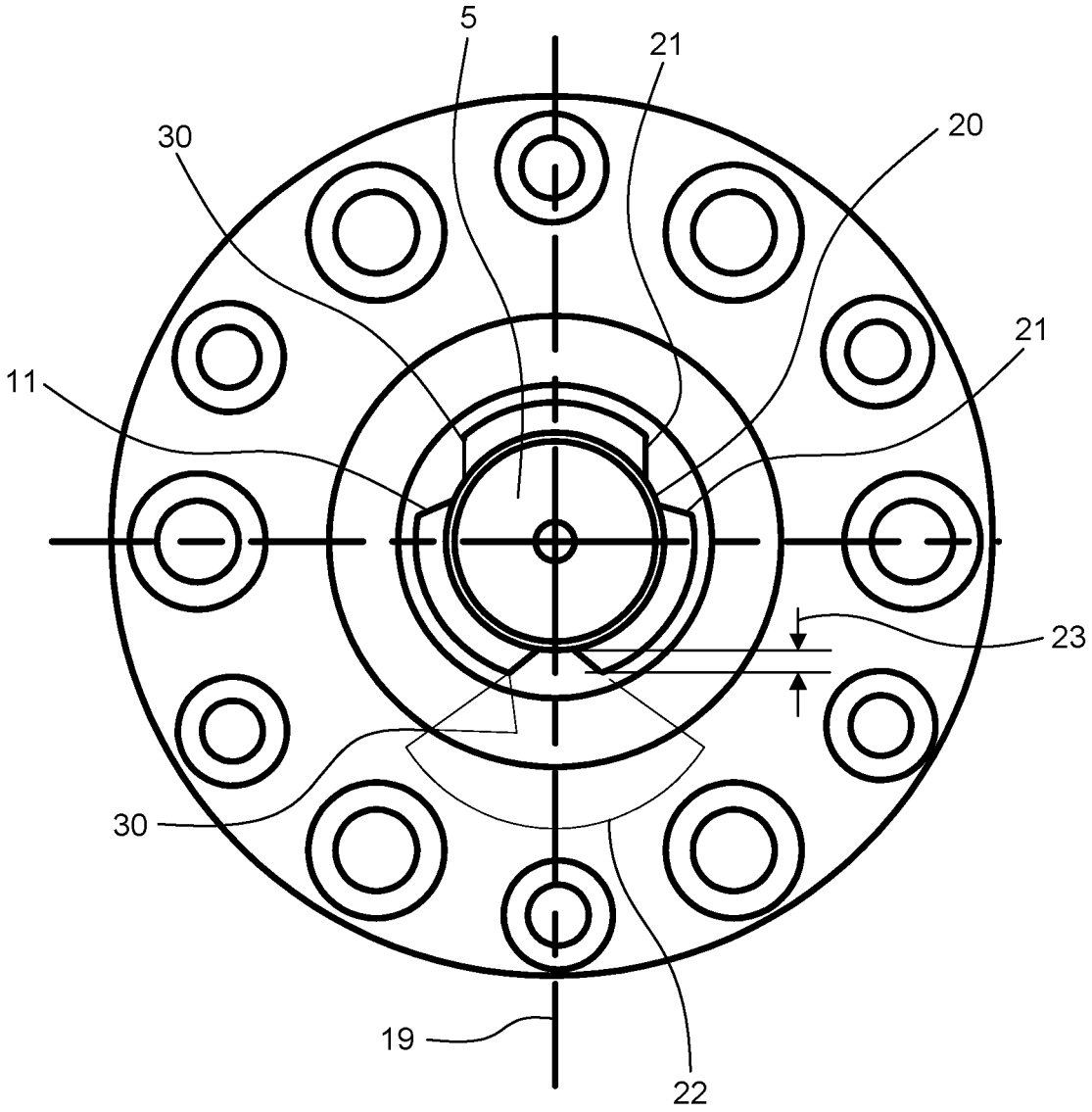
FIG. 7 is a front view of a central shaft of a torque activated chuck according to an embodiment in accordance with the present disclosure.

Referring to FIG. 5 in embodiments, an angular stroke 16 of relative rotation of the expansion units 12 with respect to the central shaft 5 around the axis of rotation 6 (angular actuation stroke) is shown. The angular stroke 16 corresponds to a total radial stroke of the expansion units 12 from the retracted (end of stroke) position and the expanded (end of stroke) position and vice versa, which is less than or equal to 15°, and the cam seats 11 and the cam follower members 13 limit the relative rotation of the locking bodies 12 with respect to the central shaft 5 around the axis of rotation 6 to an amplitude of maximum relative rotation less than or equal to 30°, i.e., twice the angular actuation stroke 16. The cam follower members 13 form a first convex cam surface 17 in contact with a second concave cam surface 18 of the corresponding cam seat 11. In a plane of section substantially orthogonal to the axis of rotation 6, the first convex cam surface 17 has a circular arcuate shape and the second concave cam surface 18 has a symmetric shape with respect to a radial symmetry plane 19 as seen in FIG. 7 to the rotation axis 6, with an arc-shaped bottom section 20 and two opposite sides 21, substantially rectilinear, defining between them a cam angle 22 in the range from 100° to 120°, and preferably from 105° to 115°, and even more preferably, 110°.

Figure 8:
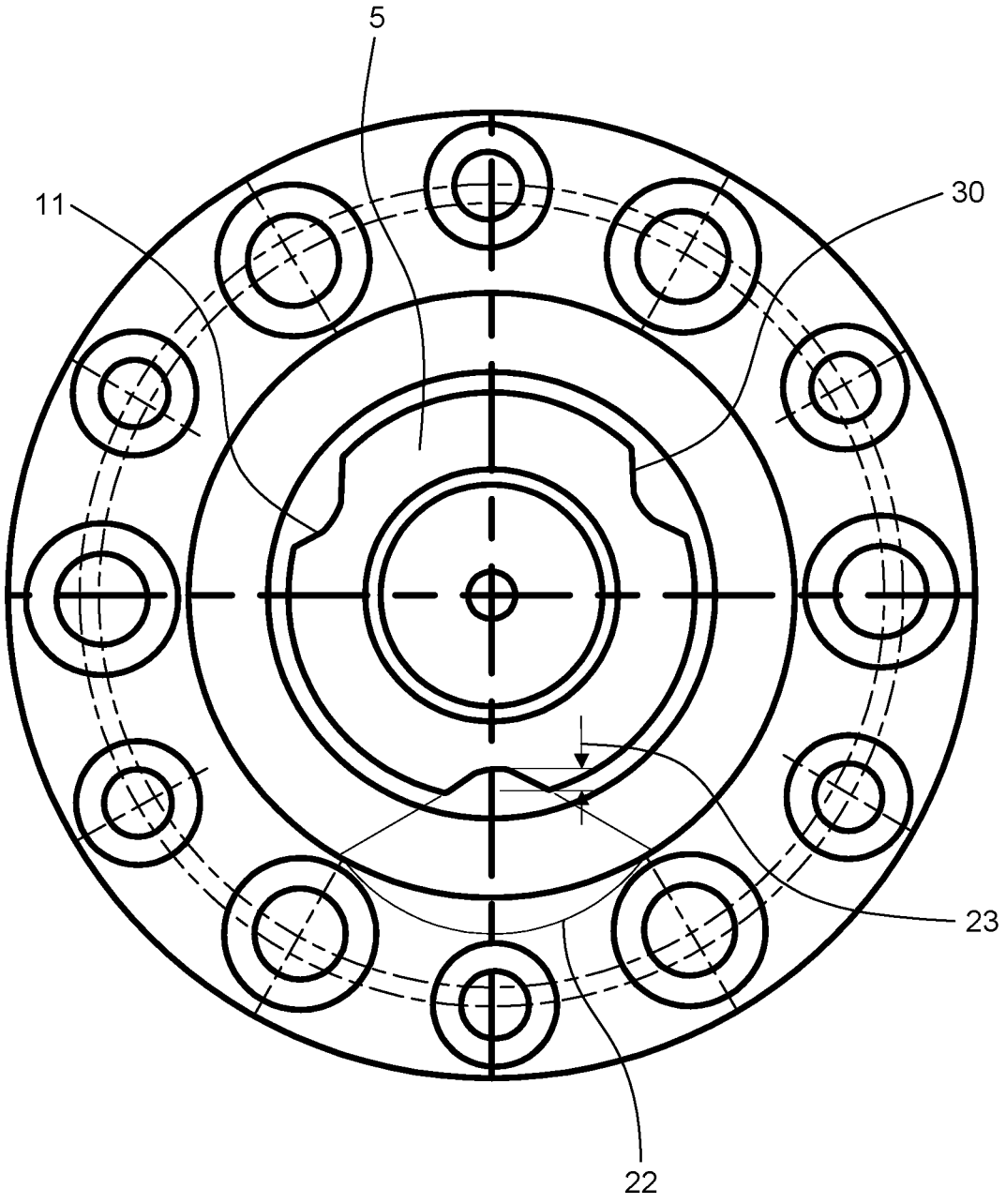
FIG. 8 is a front view of a central shaft of a support spindle according to a further embodiment in accordance with the present disclosure.

FIG. 8 is a front view of a central shaft 5 of a support spindle. In embodiments, a radial depth 23 of the cam seat 11 is greater than the total radial stroke 24 (of FIG. 5) of the expansion units 12 between the retracted (substantially end of stroke) position and the expanded (substantially end of stroke) position, and a circumferential width 25 of the cam seat 11 is greater than four times the radial depth 23 of the cam seat 11.

Thanks to the particular geometry of the cam seat 11, a significant radial displacement of the expansion units 12 (depicted in FIG. 1) may be obtained with a reduced angular actuation stroke (engagement/disengagement) with respect to conventional systems found in the prior art, and with a more immediate engagement and disengagement effect. Consequently, during the engagement and disengagement phases of the torque activated chuck 1 with the winding core 2 (shown in FIG. 12), the slippages of the winding core 2 with respect to the torque activated chuck 1 and the uncertainties of real angular position of the coil 4 with respect to at its planned angular position are minimized and/or mitigated. In addition, the geometry of the cam seat 11 of the cam follower 13 allows reciprocal rolling and/or sliding with less friction and less wear compared to the prior art, resulting in an increase in the life span of the torque activated chuck 1.

In embodiments, referring again to FIG. 1 the central shaft 5 can be made of metallic material, for example steel. The connection portion 7 can further include a connection flange in the shape of a circular disk or circular ring, extended in a plane orthogonal to the rotation axis 6, and forming a plurality of fixing holes 26 for connecting the torque activated chuck 1.

Figure 9:
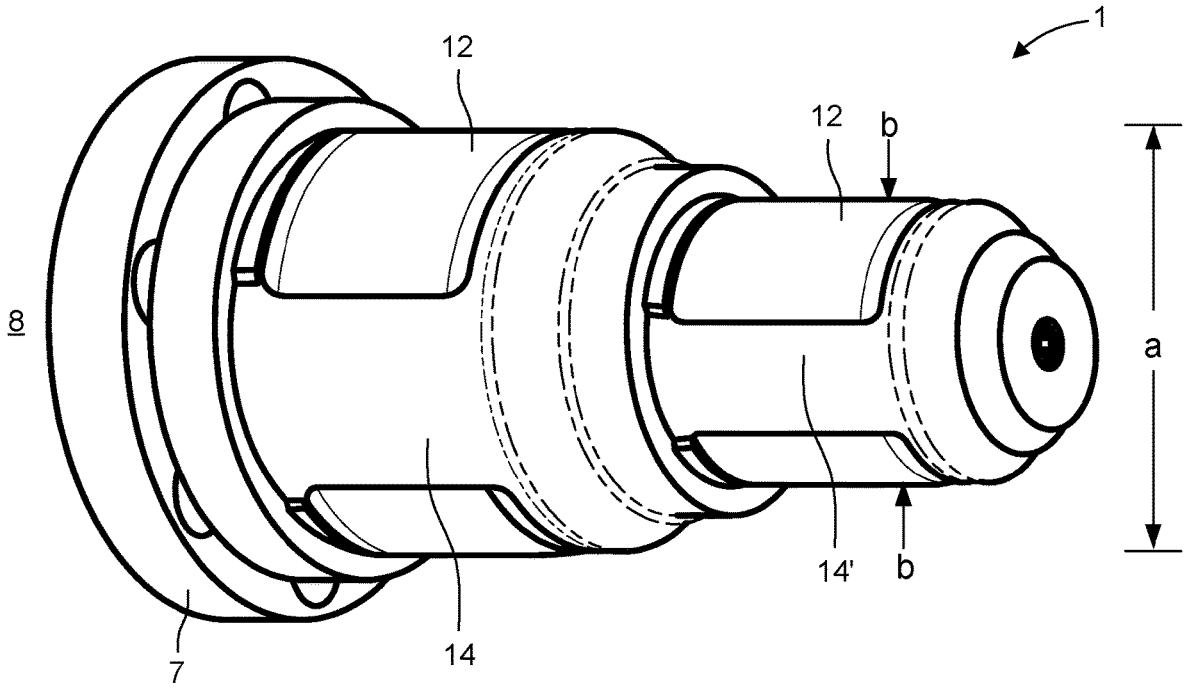
FIG. 9 is a perspective view of a two-diameter torque activated chuck according to a further embodiment in accordance with the present disclosure.

FIG. 9 illustrates a perspective view of the torque activated chuck 1, according to embodiments of the present disclosure. In some aspects, the torque activated chuck 1 can include a two-diameter support spindle that includes a connecting portion 7 a first frame portion 14 and a first expansion unit 12 that has a radius of "a". The torque activated chuck 1 includes an additional torque activated chuck portion that has a substantially smaller overall radius "b" where the radius a is greater than the radius b.

Figure 10:
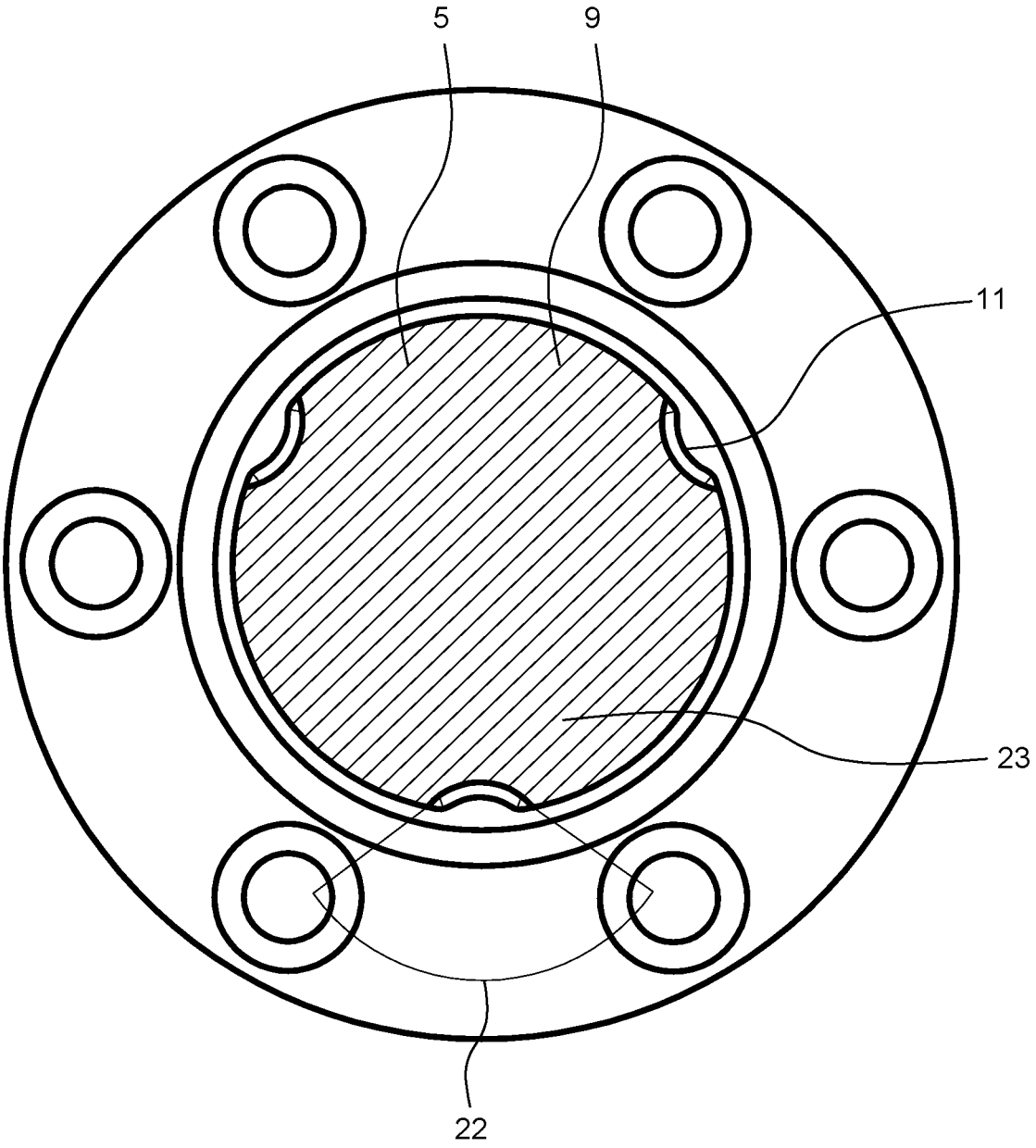
FIGS. 10, 11 are section views of a central shaft of the two-diameter support spindle in accordance with the present disclosure.

FIG. 10 is a section view of a central shaft 5 of the two-diameter support spindle in accordance with the present disclosure. The section view again shows the arc-shaped bottom section and two opposite sides of the cam seat(s) 11, where the opposite sides of the cam seat define between them the cam angle 22.

Figure 11:
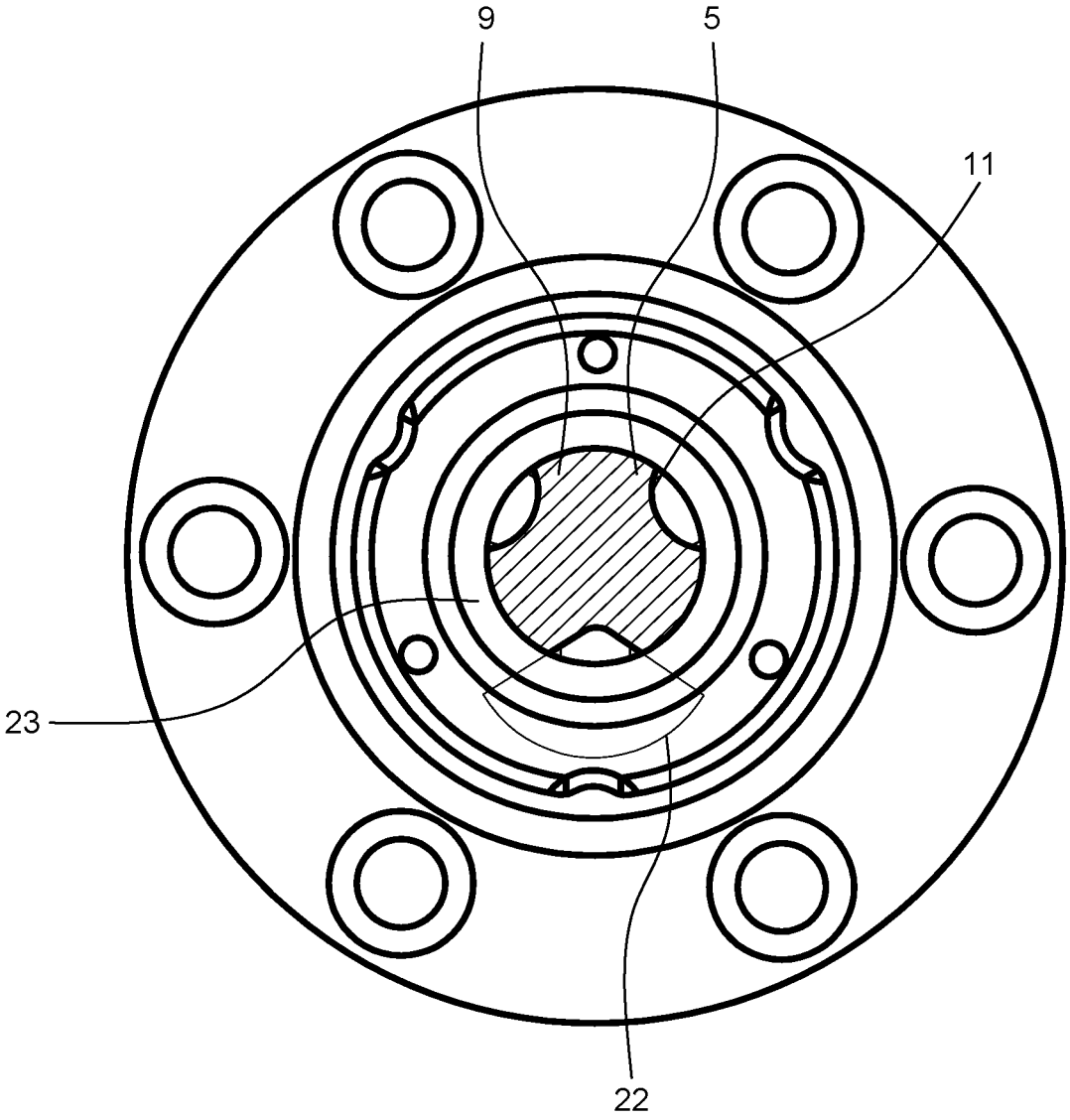

FIG. 11 is a section view of a central shaft 5 of the two-diameter support spindle in accordance with the present disclosure. FIG. 11 illustrates a relative alignment of the cam angle 22, cam seats 11 disposed on peripheral positions of support portion 9.

Referring to FIG. 12 a movement system 27 is illustrated with a drive motor 28 and/or with a brake to carry out the positioning and controlled rotation of the torque activated chuck 1 in order to engage/disengage the winding core 2 with material 3 and carry out the unwinding and/or winding of the reel 4.

Figure 13:
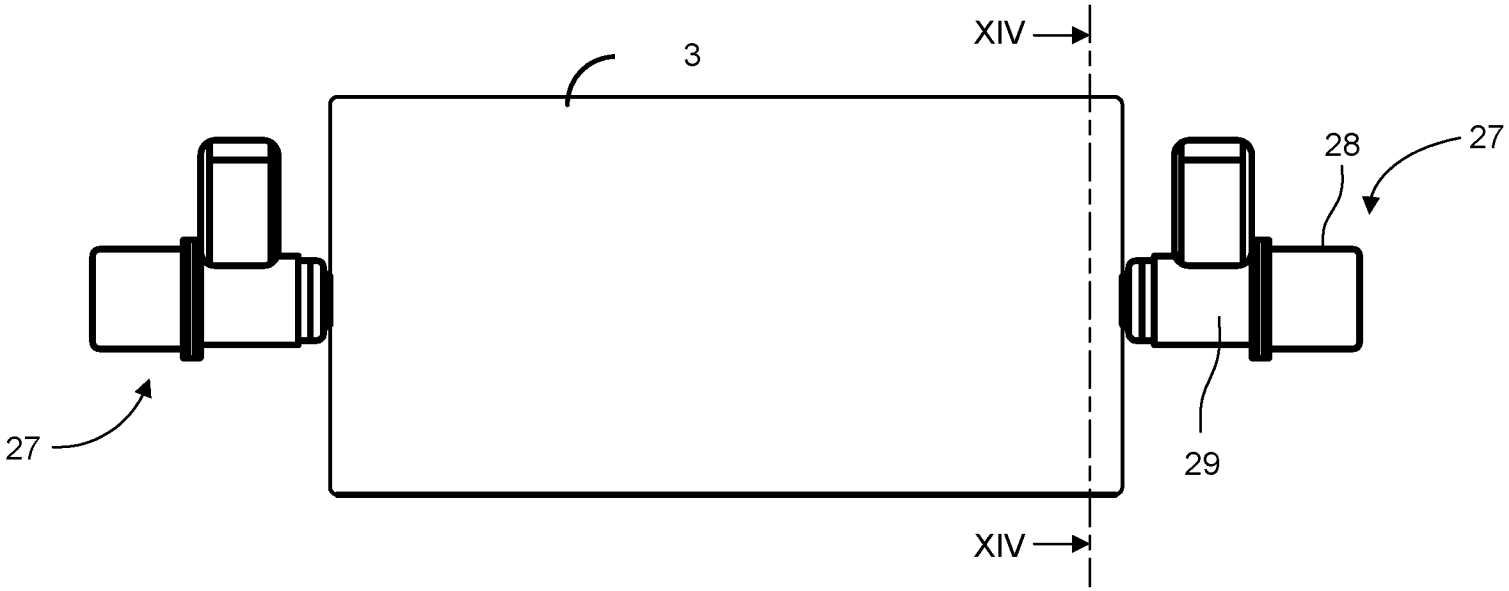

FIG. 13 illustrates a position of the torque activated chucks 1 engaging the core 2 (not shown). In this regard the movement system 27 has positioned the torque activated chucks 1 such that a portion of the torque activated chuck 1 is positioned and engaged with the winding core 2 (of FIG. 12).

Figure 14:
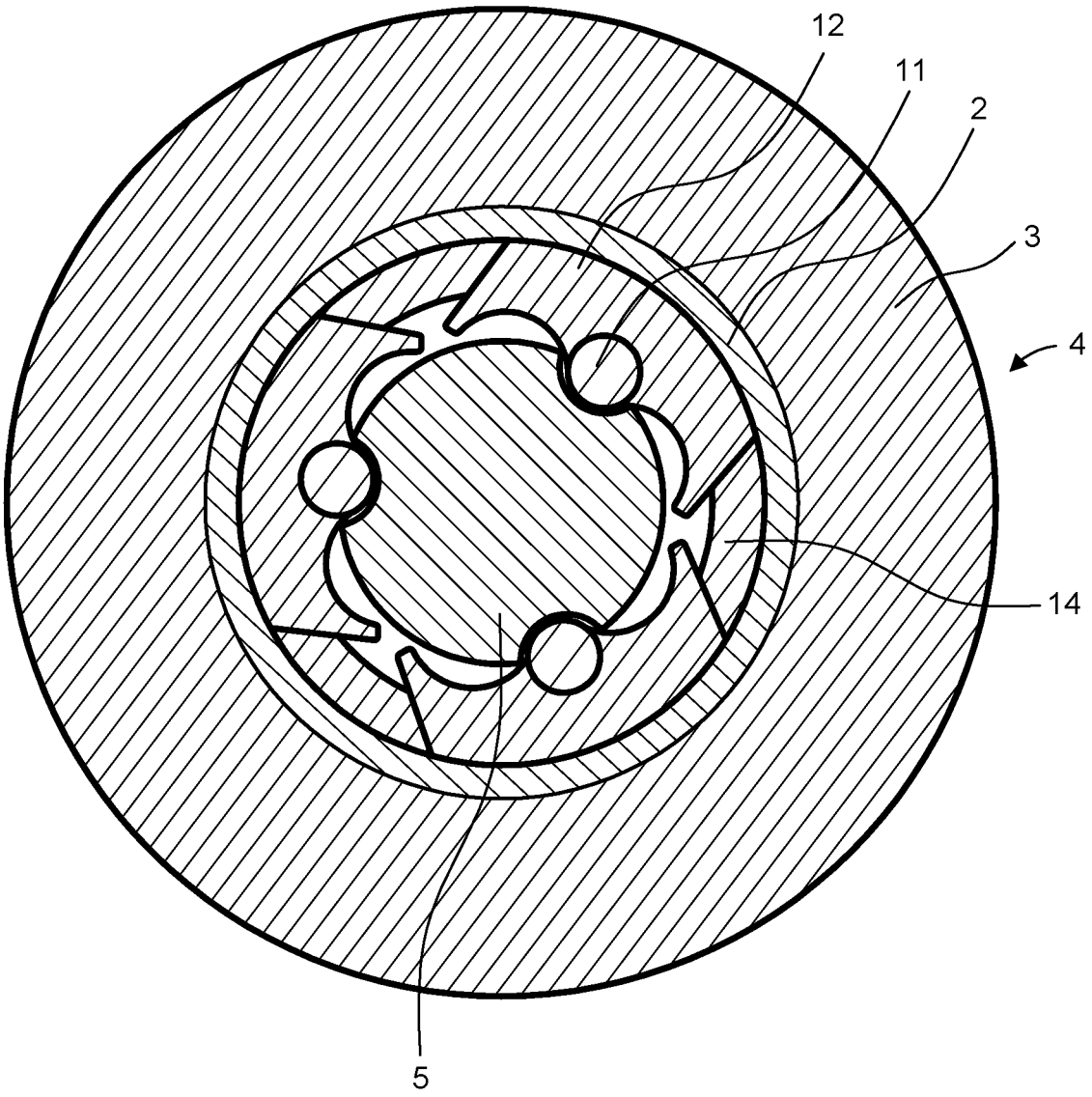
FIG. 14 is a section view according to the section plane XIV-XIV in FIG. 13 in accordance with the present disclosure.
Figure 15:
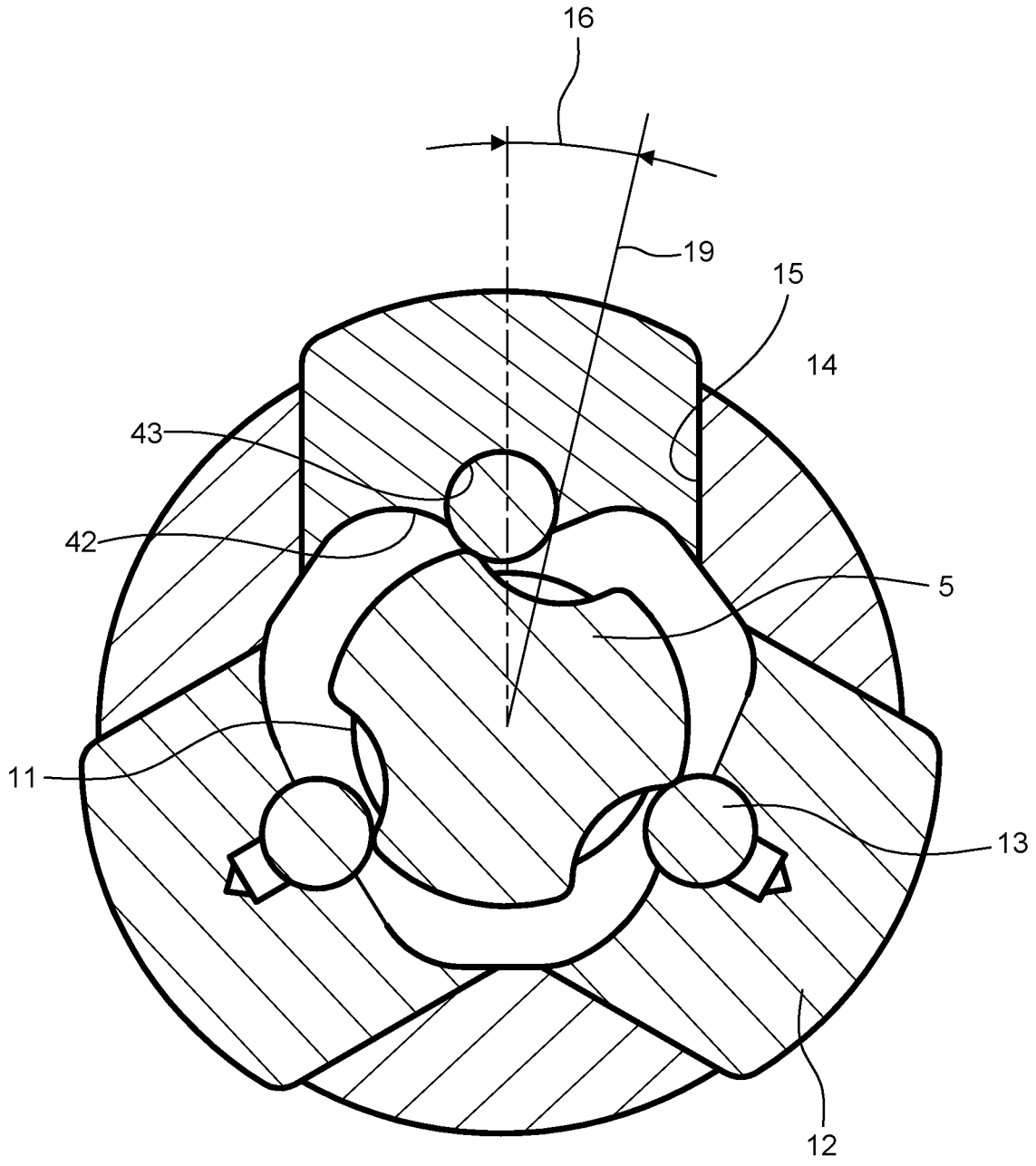
FIGS. 15, 16, 17, 18 are sectional views of parts of support spindles according to embodiments, having different engagement diameters with the winding core and being in a completely radially expanded configuration in accordance with the present disclosure.

FIG. 15 illustrates a cut-away view of FIG. 13 along the line XIV. FIG. 14 includes a central shaft 5 with cam follower members 13 contacting expansion units 12, which are in a retracted position as shown in FIG. 14. A reel 4 having a core 2 substantially surrounds the assembly and rolled material 3 is coiled about the core 2.

The support portion 9 has an elongated shape with a cylindrical external surface in which the cam seats 11 are formed. The cam seats 11 can be extended parallel to the axis of rotation 6 along the entire support portion 9 and have a constant section shape along the axis of rotation 6.

The support portion 9 comprises three cam seats 11 uniformly distributed at an angle of about 120°.

The bottom section 20 can advantageously have the shape of an arc of a circle having a radius in the range from about 17 mm to 23 mm, preferably from about 19 mm to 21 mm, even more-preferably 20 mm.

The radial depth of the cam seat 11, measured along the symmetry plane 19 up to an external circumference of the support portion 9, is advantageously in the range from 6 mm to 7 mm, preferably about 6.5 mm.

The lateral sections 21 join at opposite ends of the bottom section 20 with an orientation tangent to the arc of the circle of the bottom section 20.

A lateral edge 30 in a region of intersection of the lateral portions 21 of the cam seats 11 with the external circumference of the support portion 9, is advantageously shaped as, for example, a chamfer a convex surface, a concave surface, an arcuate surface. The illustrated example includes a relief radius of about 0.5 mm.

The external surface of the support portion 9 between respectively two cam seats 11 is preferably cylindrical and concentric with respect to the rotation axis 6.

The shape characteristics of the support portion 9 allow its precise and economic manufacture, a favorable balance for rotational movements and a reduction of the friction between the cam seats 11 and the cam follower members 13, which will be described in following.

Depending on the size and weight of the reels 4 to be wound and unwound, and therefore of the support cores 2, the support portion 9 of the mandrel 1 can be made with axial length and with different diameters. Advantageously, the shape and size of the individual cam seats 11 can remain unchanged for a plurality of different diameters of the support portion 9.

Figure 16:
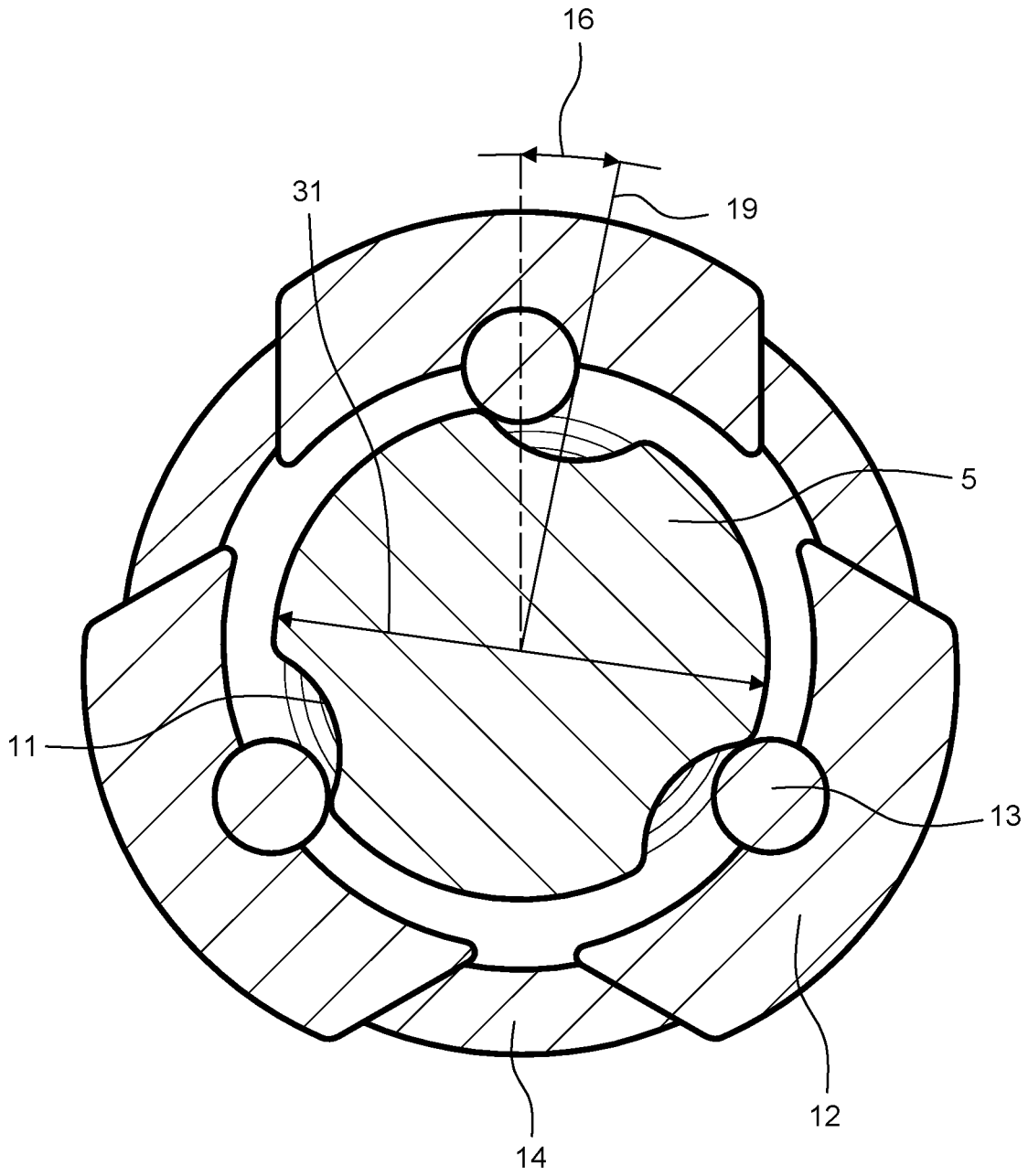
Figure 17:
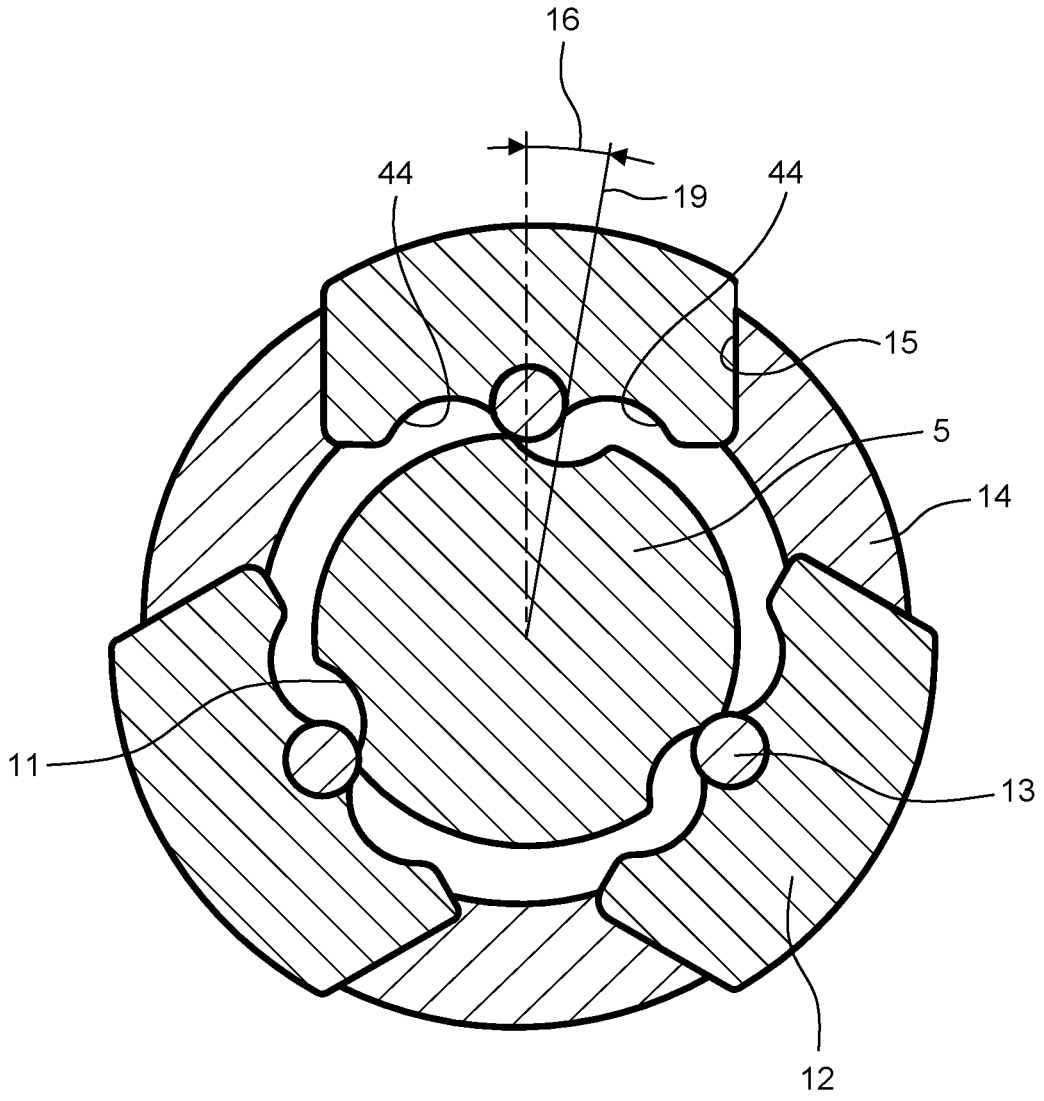
Figure 18:
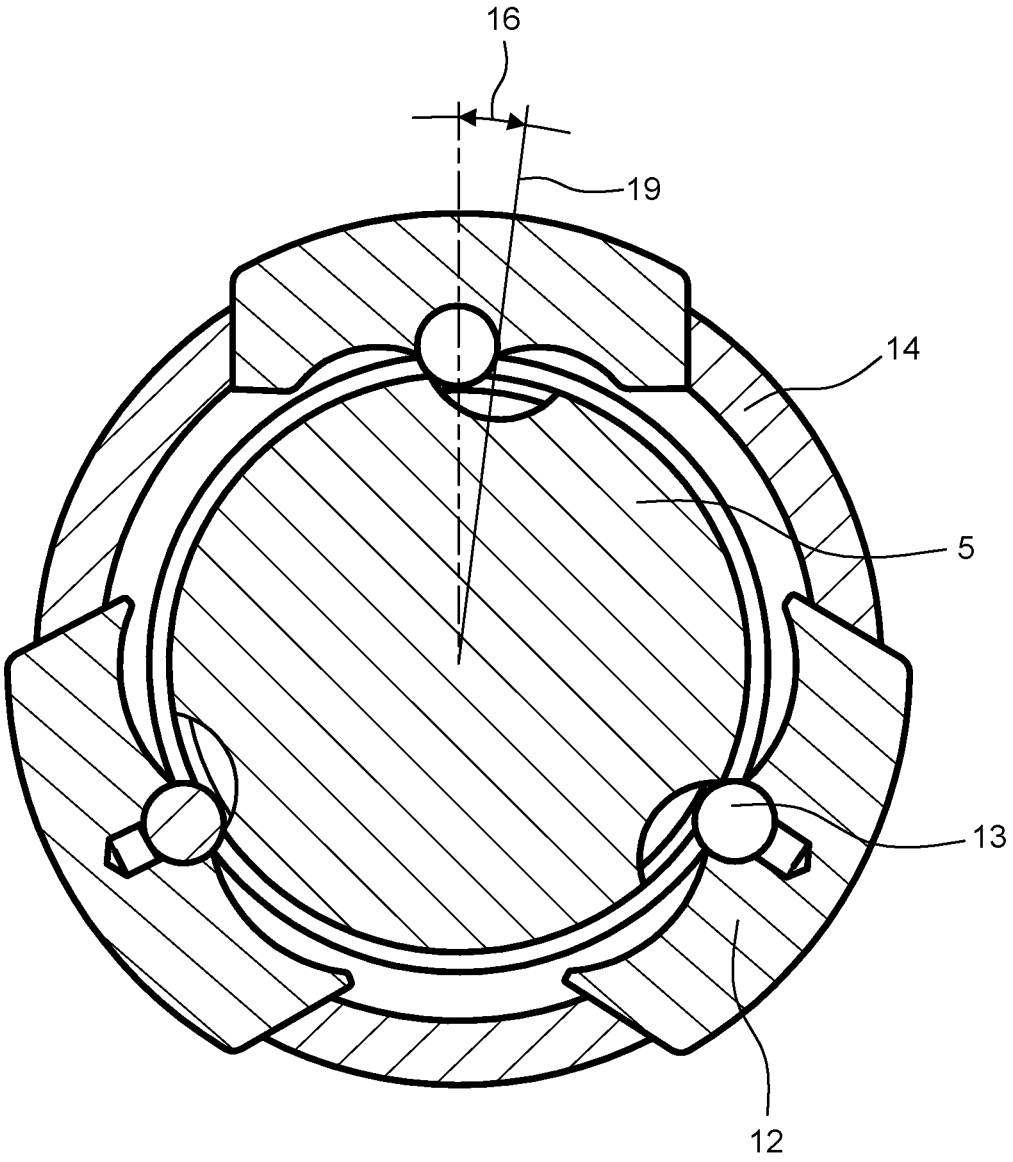

In embodiments, with the geometric shape and dimensions of the cam seats 11 described above, and with the arrangement of three cam seats 11 with an angular pitch of 120°;

for a diameter 31 of the support portion 9 of about 45 mm, the angular stroke of actuation 16 is about 10° to 25°, and most preferably, 20°. (FIG. 15), for a diameter 31 of the support portion 9 of about 62 mm, the angular stroke of actuation 16 is about 15° to 18°, and most preferably, 16.5° (FIG. 16), for a diameter 31 of the support portion 9 of about 82 mm, the angular stroke of actuation 16 is about 13° to 17°, and most preferably, 15.5°. (FIG. 17), for a diameter 31 of the support portion 9 of about 102 mm, the angular stroke of actuation 16 is about 11° to 13°, and most preferably, 12.5° (FIG. 18).

In accordance with embodiments FIGS. 1, 2 illustrate, the central shaft 5 forms, on two opposite sides of the support portion 9, a first rear bearing seat 32 in the shape of a cylindrical step and a first bearing seat front 33 in the shape of a cylindrical step which houses a rear bearing 34 and a front bearing 35 for a rotatable support of the support cage 14 with respect to the central shaft 5 around the axis of rotation 6.

Figure 23:
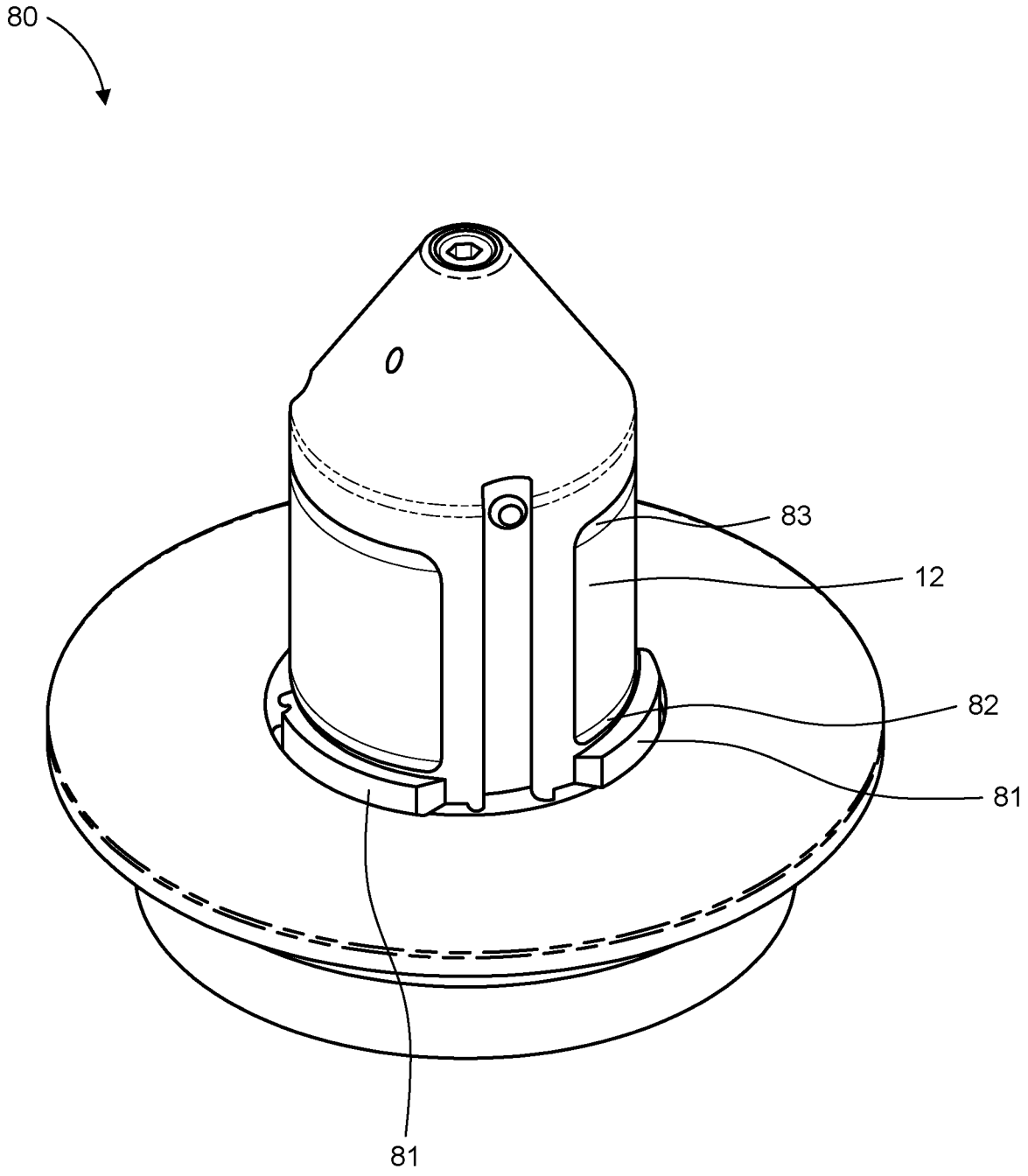
FIG. 23 depicts a front view of the torque activated chuck in accordance with the present disclosure.

Referring to FIG. 1, in embodiments, the expansion units 12 are preferably made of metallic material, for example steel, and from a radially external engagement surface 36, preferably in the shape of a cylinder part, intended for an engagement to pressing contact against an intrados of the winding core 2. The engaging surface 36 preferably has a length in the direction of the rotation axis 6 greater than its width in a circumferential direction with respect to the rotation axis 6. At two longitudinally opposite ends 37 of the expansion unit 12 the engaging surface 36 is sloped, scalloped, curved, undular, including perturbations or arranged in a arcuate profile in a direction radially inward so as to reduce the risk of jamming with the intrados of the winding core 2 and the risk of damage to the expansion unit 12 or of the winding core 2 during their mutual insertion and disconnection. In one or more embodiments, the expansion unit 12 engaging surface 36 may be relieved at a single end closest to the connection portion 7 only, such that only the open end of a winding core (not shown in FIG. 1) is relieved by the relief feature 82 as shown in FIG. 23, for example). Furthermore, in embodiments the inclination of the engagement surfaces 36 at the opposite longitudinal ends 37 facilitates a movement radially inwards of the expansion units 12 "freely hung" in the support cage 14 during the insertion of the torque activated chuck 1 in the winding core 2. The opposing longitudinal end 37 may be similar or dissimilar to the opposing end and may include shapes sloped, scalloped, curved, undular, including perturbations or arranged in a arcuate profile in a direction radially inward The expansion unit 12 also forms sliding surfaces 38, 39 transverse to the engagement surface 36, in particular, two planar longitudinal sliding surfaces 38, parallel to each other and to the rotation axis 6, and 1 or two transversal sliding 39 planar and orthogonal to the rotation axis 6 (FIG. 1).

The sliding surfaces 38, 39 are complementarily shaped with corresponding guide surfaces 40, 41 of the guide seats 15 of the support cage 14 to retain the expansion units 12 in the guide seats 15 in a radially sliding manner with respect to the rotation axis 6.

Figure 3:
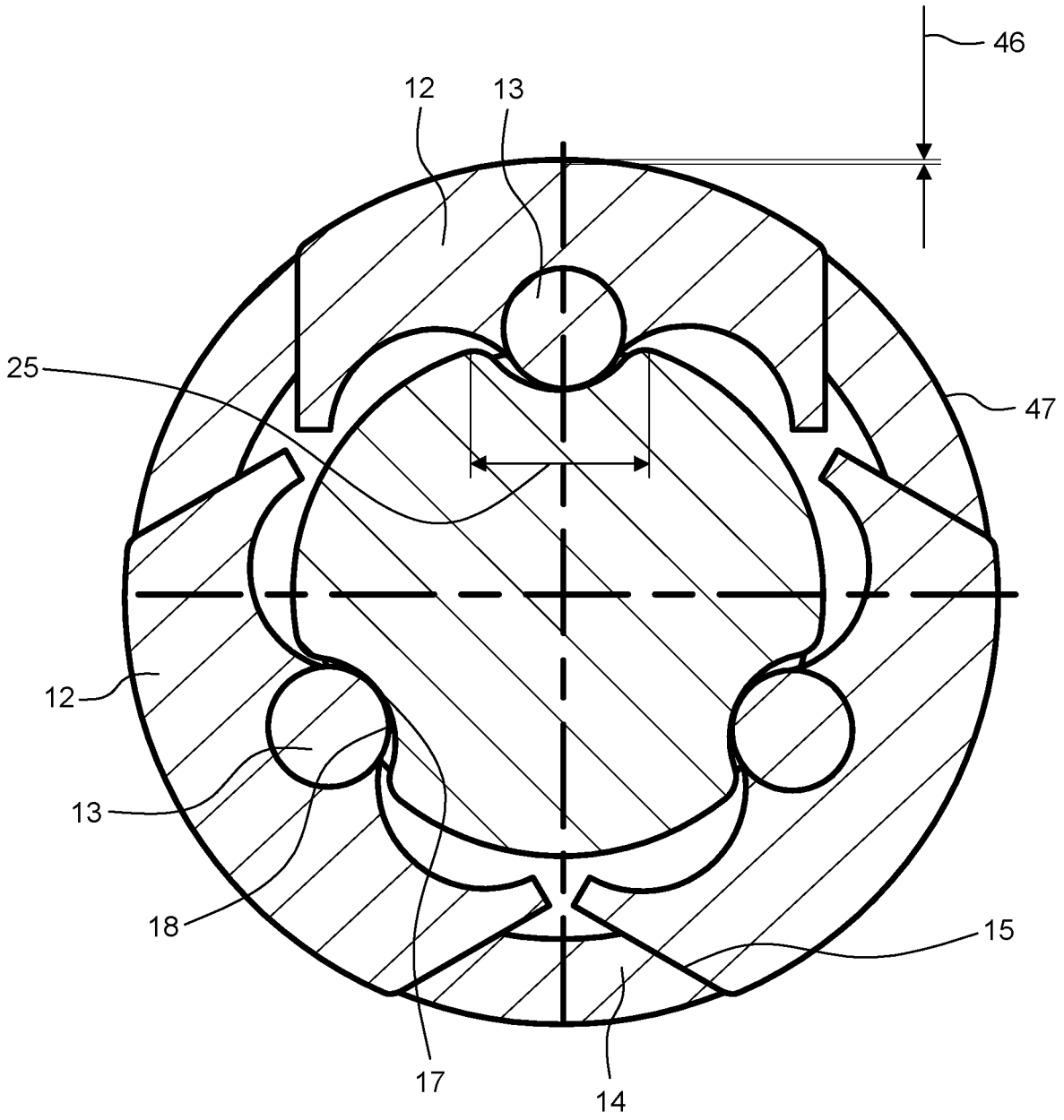
FIGS. 3 and 4 are sectional and lateral views, respectively, of a torque activated chuck in a retracted configuration in accordance with the present disclosure.

The expansion units 12 also form a radially internal surface 42 facing the support portion 9 and which forms or accommodates the one or more cam follower members 13 as illustrated in FIGS. 2, 3, 5. In accordance with an embodiment, the cam follower members 13 are rolling bodies (preferably metallic, for example made of steel) rotatably accommodated in cavities 43 formed in the radially internal surfaces 42 and contact the cam seats 11 with rolling friction. Alternatively, the cam follower members 13 can be directly formed by the expansion units 12 and contact the cam seats 11 with sliding friction.

Advantageously, the cam follower members 13 are elongated cylindrical bodies inserted in the longitudinal direction (along the axis of rotation 6) in the corresponding cavities 43 of partially cylindrical shape and extended in a direction parallel to the axis of rotation 6. The positioning planned of the cam follower members 13 in the cavities 43 can be secured by a positioning dowel 50 screwed into a positioning hole of the expansion unit 12 (FIG. 2).

In embodiments, the radially internal surface 42 of the expansion units 12 forms two lateral cavities 44, arranged on two opposite sides with respect to the cam follower 13 to overcome the risk of violations of space between the body of locking 12 and the support portion 9, in particular when the expansion unit 12 is in the retracted position (FIG. 3) radially closer to the central shaft 5. The lateral cavities 44 are delimited, on one side by the cam follower member 13 and on the other side by one of two lateral guide walls 45 extended on each longitudinal side of the expansion unit 12, protruding towards the inside of the torque activated chuck 1 and forming the longitudinal sliding surfaces 38 (FIG. 3).

This configuration reconciles the need to avoid violations of space inside the torque activated chuck 1 during the relative actuation rotations, to lighten the torque activated chuck 1, and to provide a radial guide long enough for the expansion units 12.

The total radial stroke 24 of the expansion units 12 is in the range from about 3 mm to about 8 mm preferably from about 4 mm to about 6 mm, even more preferably about 5 mm.

Figure 4:
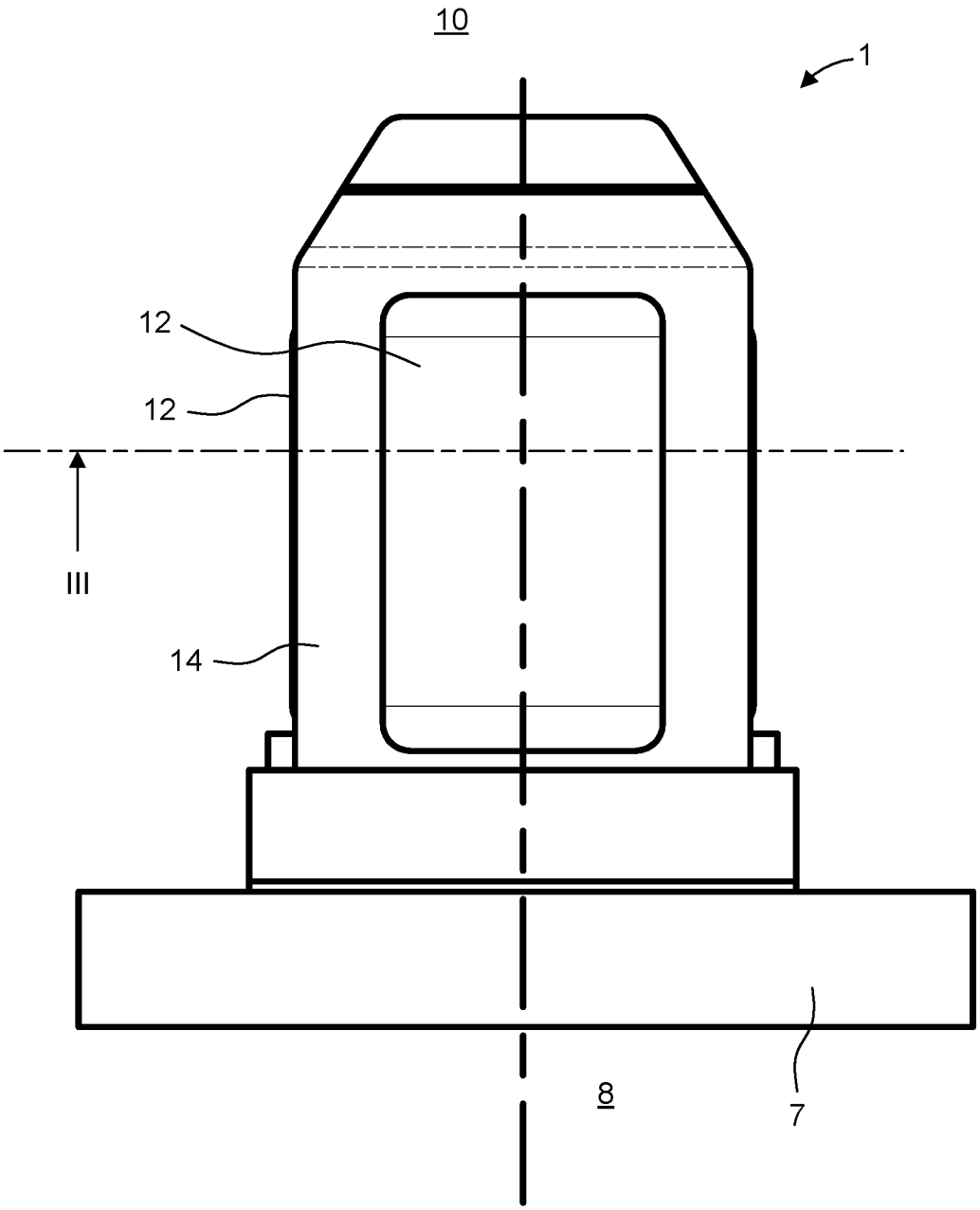
Figure 5:
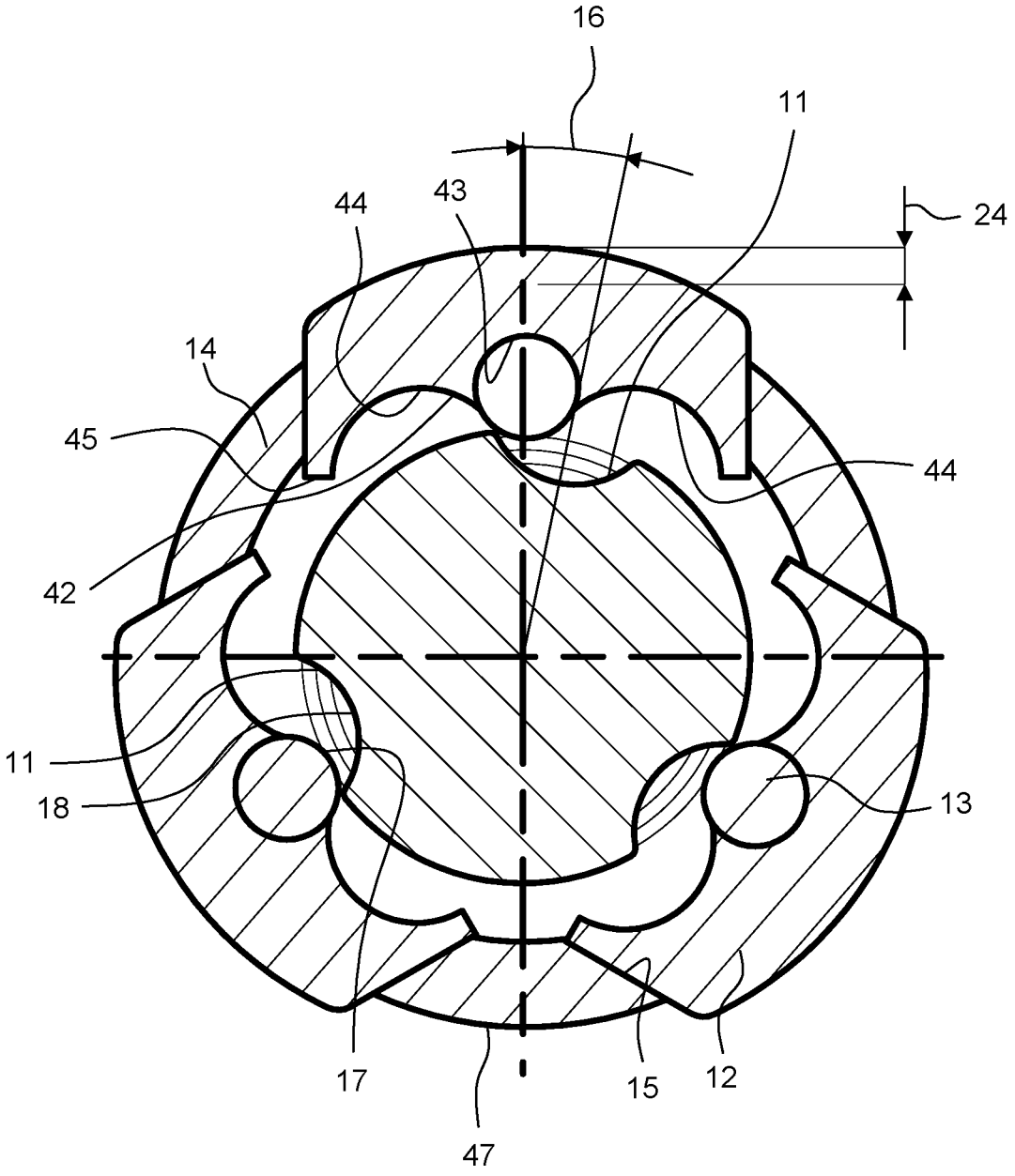
FIGS. 5 and 6 are respective sectional and lateral views of the mandrel in FIGS. 3 and 4, in a radially expanded configuration in accordance with the present disclosure.
Figure 6:
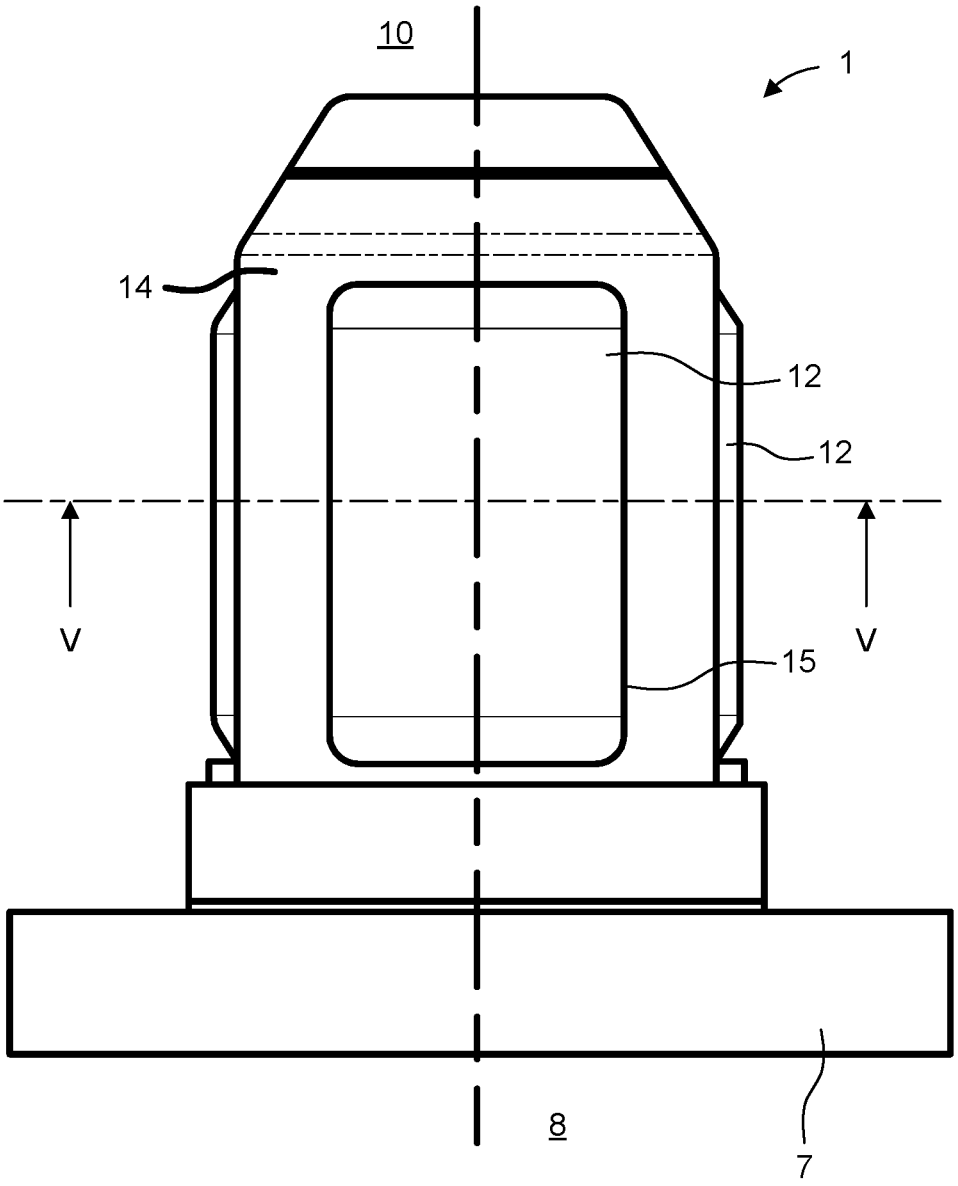

In the retracted position, the expansion units 12 preferably protrude with respect to an external surface 47 of the support cage 14, for example with an initial radial protrusion value 46 in the range from about 5% to about 15% of the total radial stroke 24, preferably with an initial radial protrusion value 46 of about 10% of the total radial stroke 24, for example about 0.5 mm (FIGS. 3-5).

Each expansion unit 12 further forms one or more, preferably two stop projections 48 which abut against corresponding end of stroke surfaces 49 of the support cage 14 when the expansion unit 12 reaches the expanded position. This prevents complete release and loss of the expansion units 12 of the guide seats 15, for example when the torque activated chuck 1 is not inserted in a winding core 2.

Referring again to FIGS. 1 and 2, in embodiments, the support cage 14 can be made of metal, for example steel, and comprise a tubular wall 51, inserted concentrically on the support portion 9 of the central shaft 5, and having a surface external 47, preferably cylindrical, and an (radially) internal surface 52 facing the support portion 9 of the central shaft 5.

The internal surface 52 forms, on two opposite sides with respect to the guide seats 15, a second rear bearing seat 53 in the shape of a cylindrical step and a second front bearing seat 54 in the shape of a cylindrical step which accommodate {outer rings of the) bearings 34 and front 35 for the rotating support of the support cage 14 with respect to the central shaft 5 around the axis of rotation 6.

The guide seats 15 are formed by openings passing through the tubular wall 51, delimited by the longitudinal guide surfaces 40 and transverse guide surfaces 41 for the guided sliding support of the expansion units 12 (see, for example, FIGS. 1, 2, 3, 4).

The possibility of relative rotation of the expansion units 12 with respect to the support portion 9 of the central shaft 5 is guaranteed by the rotatable support of the support cage 14 with respect to the central shaft 5. The amplitude of the relative rotation is defined and limited by the radial limit stop of the expansion units 12 in the expanded position and by two opposite rotational limit stops, made by each cam seat 11 together with the corresponding cam follower member 13 (FIG. 5). According to an embodiment, on the front side 10 of the torque activated chuck 1 the support cage 14 is chamfered, rounded or tapered, so as to facilitate the insertion of the torque activated chuck 1 in the winding core 2.

Advantageously, the support cage 14 is axially locked on the central shaft 5 by means of a closing plate 55 fastened on the front 10 into a hole formed in a front surface of the central shaft 5. The closing plate 55 it is advantageously chamfered, rounded or tapered in accordance with the corresponding chamfering or tapering of the support cage 14.

The rear bearing 34 is a tapered roller bearing, suitable for an axial and radial support of the support cage 14, while the front bearing 35 is preferably a radial bearing, for example ball bearings or a tapered roller bearing. The support cage 14 can form one or more through ejection holes 56, in communication with the second rear bearing seat 53, for the access of a tool (for example a pin) to expel the outer ring of the tapered bearing from the second rear bearing seat 53 (FIG. 2). Furthermore, an annular plate 56 for protection against dust can be arranged inside the support cage 14 between the rear bearing 34 and the cam-follower members 13.

According to a further embodiment (FIGS. 9, 10, 11), the torque activated chuck 1 can form a plurality of, preferably two, support portions 9, of different diameters, concentric and positioned axially next to the other, as well as a plurality of corresponding support cages 14, of different diameters, concentric and positioned axially next to each other, with the smaller diameter cage positioned more on the front side 10 of the torque activated chuck 1, for a versatile use of the torque activated chuck 1 in combination with winding cores 2 having different diameters.

Figure 19:
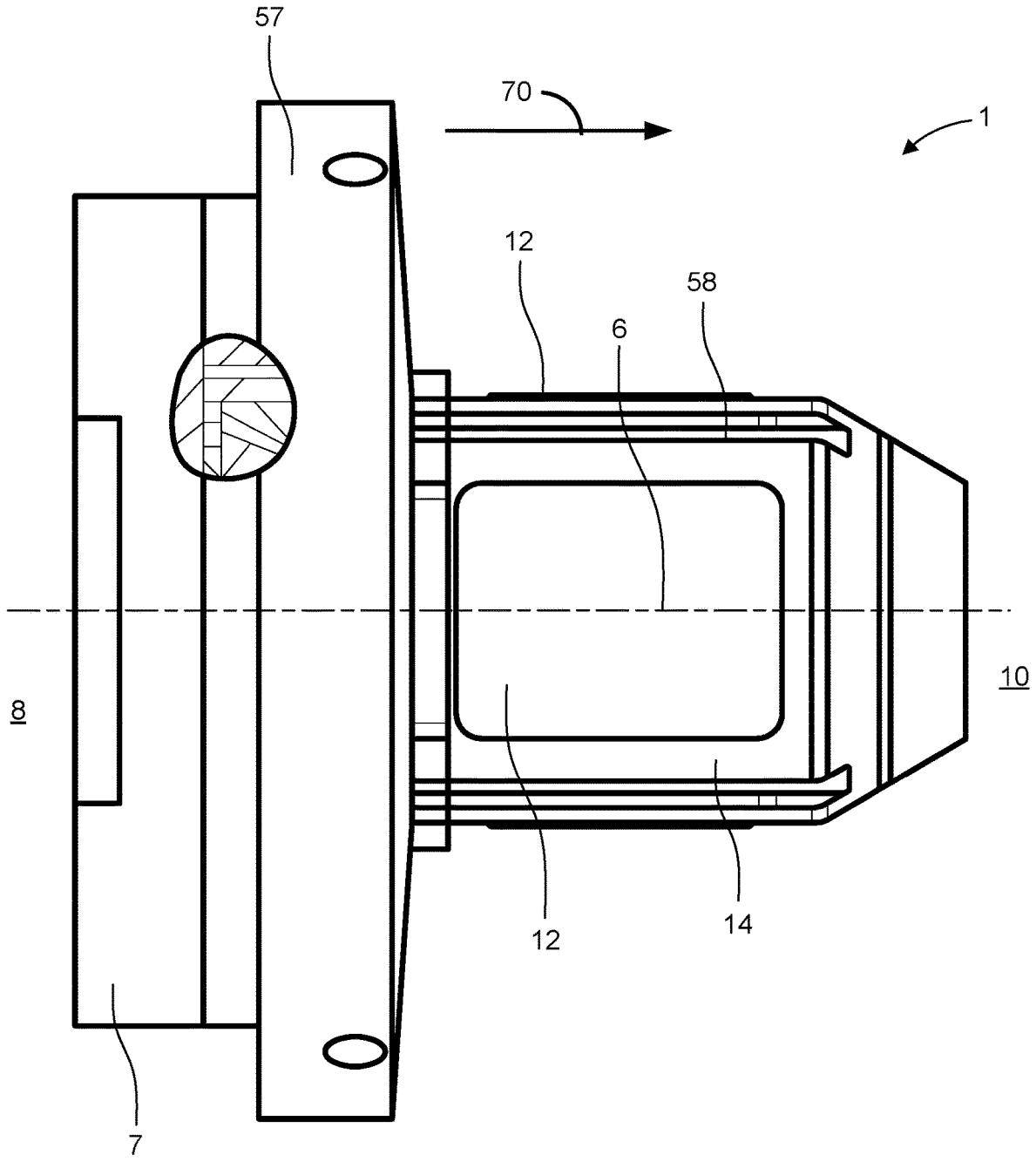
FIG. 19 is a side view of a torque activated chuck according to an embodiment, having an expulsion and positioning flange in the fully retracted position in accordance with the present disclosure.
Figure 20:
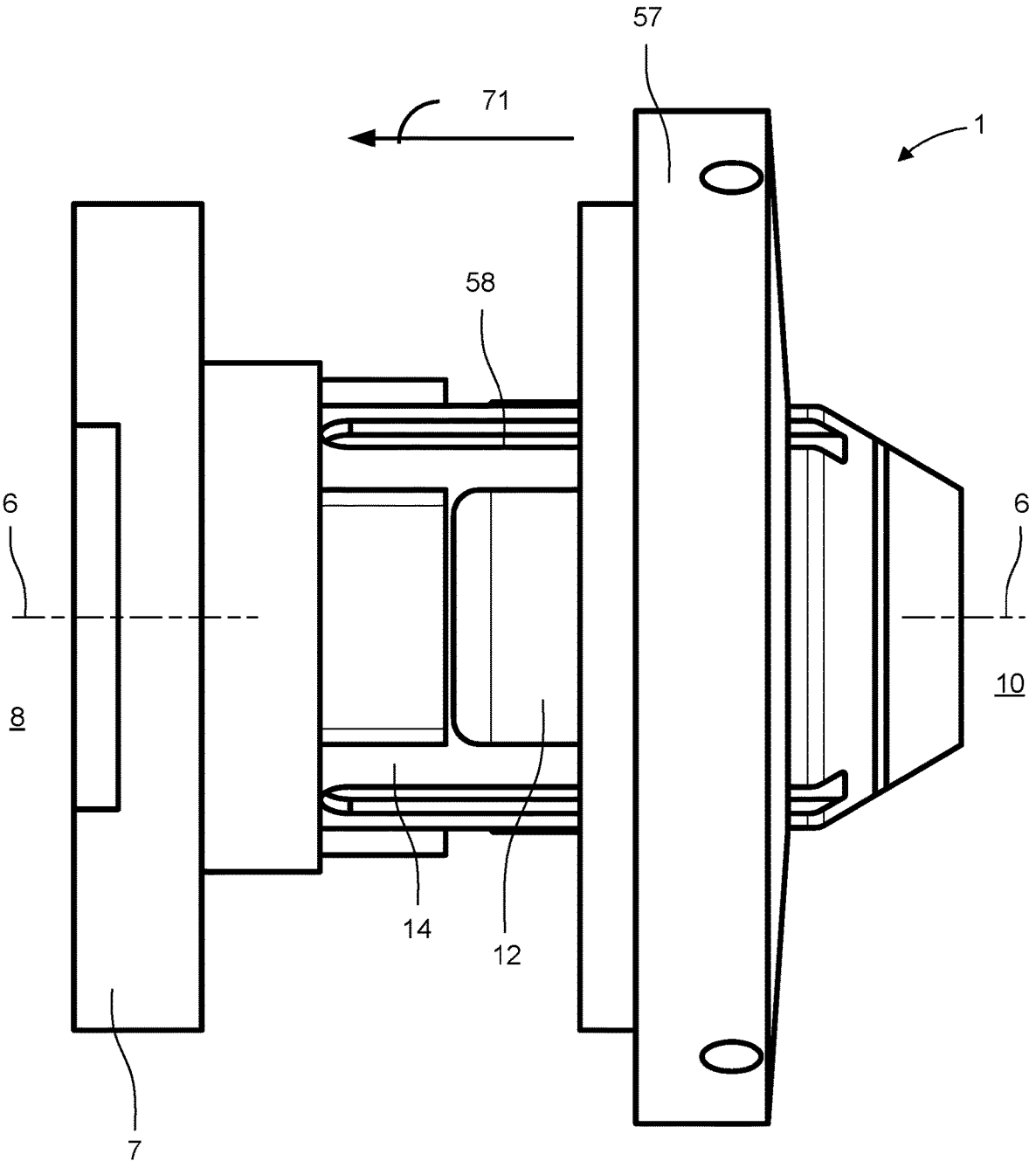
FIG. 20 shows the torque activated chuck of FIG. 19 with the ejection flange in the fully advanced position, in accordance with the present disclosure.

In embodiments FIGS. 19, 20, 21, 22, illustrate an ejection flange 57. In this regard, referring to FIG. 19, the torque activated chuck 1 can comprise a positioning and ejection flange 57 operable to axially slide with respect to the central shaft 5 and guided, for example by means of a plurality of guide grooves 58 parallel to the rotation axis 6, formed in the external surface of the support cage 14 (FIGS. 19, 20).

The positioning and ejection flange 57 can provide an axial bearing reference for the winding core 2 during the winding and unwinding phases of the reel 4, as well as acting as an ejection pusher for an easier disengagement of the torque activated chuck 1 from the winding core 2.

The ejection flange 57 is shown in FIG. 19 in a retracted position such as when the torque activated chuck is engaged with the core 2 and rotating or prior to engagement. In the illustrated example, the ejection flange 57 is arranged to travel in the direction of the arrow 70 to eject the core 2 from the torque activated chuck 1.

FIG. 20 shows the ejection flange 57 arranged proximate to a distal end of the torque activated chuck 1. Such an arrangement is operable to urge the self-activating chuck 1 to disengage from the core 2 (of FIG. 12) by applying a force by the ejection flange 57 to a region proximate to a distal end of the core 2. Once disengaged, the ejection flange 57 may travel in the direction of arrow 71 to assume a position similar to the position illustrated in FIG. 19.

Figure 21:
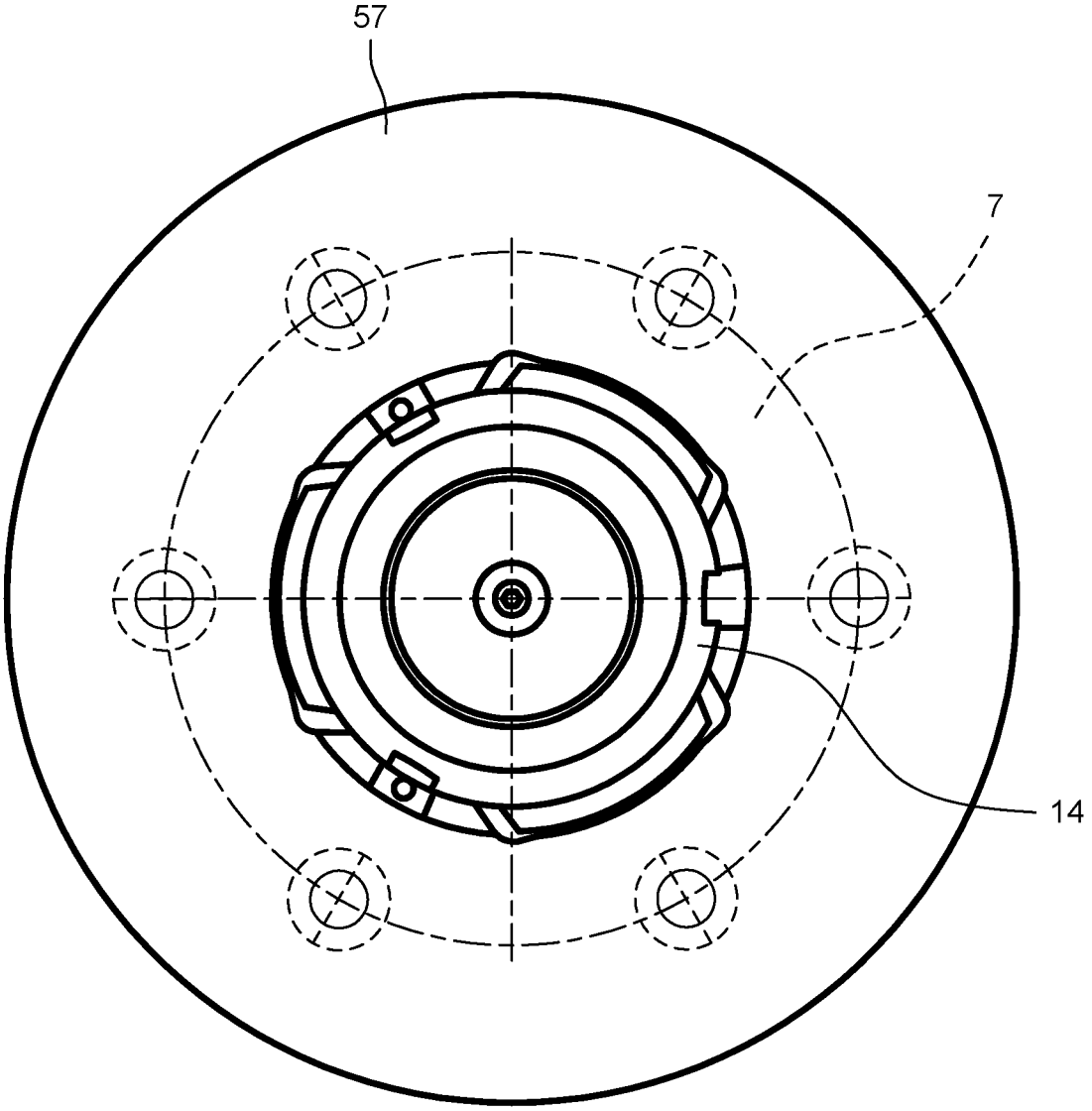
FIG. 21 is a front view of the torque activated chuck of FIG. 19 in accordance with the present disclosure.

FIG. 21 is a front view of the torque activated chuck 1 of FIG. 19 including the ejection flange 57 arranged substantially parallel to the connection portion 7.

Figure 22:
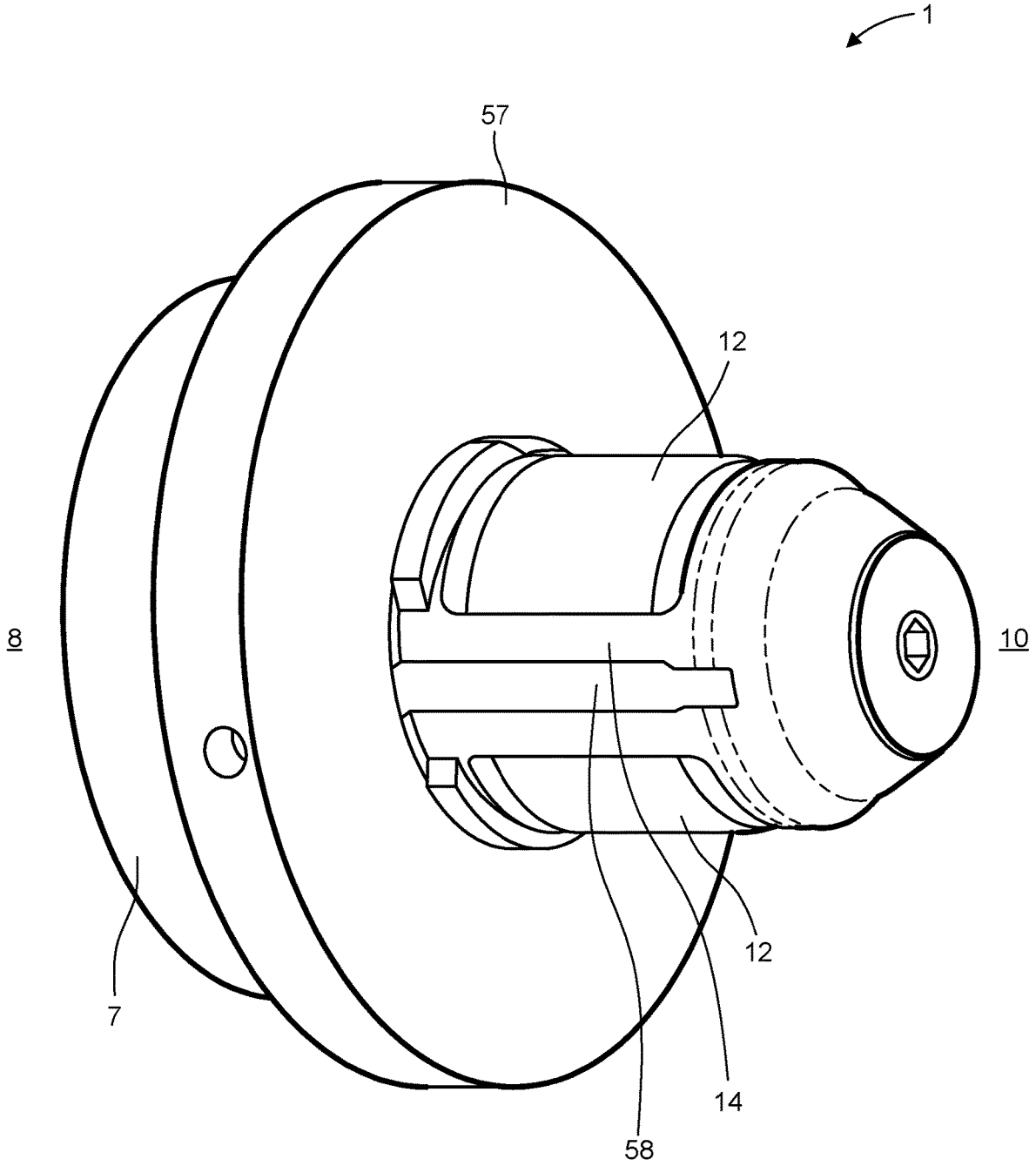
FIG. 22 is a perspective view of the torque activated chuck of FIG. 19 in accordance with the present disclosure.

FIG. 22 is a perspective view of the torque activated chuck 1 with the ejection flange 57 arranged on the torque activated chuck 1.

FIG. 23 illustrates a perspective view of embodiments of a torque activated chuck 80. The torque activated chuck 80 includes features similar to the torque activated chuck 1 illustrated in FIG. 1. The torque activated chuck 80 includes expansion units 12 having one or more core relief features 82 and/or the core relief feature 83 disposed on distal ends of the expansion units 12. The core relief features in 82 and 83 may be arranged at opposite distal ends on the expansion units 12. The core relief features 82 and 83 may include any suitable size, shape, or arrangement such that the distal ends of the expansion units may not deform a radially unsupported winding core as the final portion(s) of rolled material 3 is used.

The features that may be formed in the core relief features 82 and 83 to mitigate and/or eliminate pressure points on the material core 2. According to one or more embodiments, the core relief features 82 and/or 83 may relieve core internal pressures exerted on the interior winding core 2 surfaces as the expansion units exert outward pressure to hold the winding core 2 and rolled material 3 in use. As the rolled material 3 is used, the winding core 2 may have increasingly diminished circumferential support, and thus, the winding core may deform at the distal end in contact with the torque activated chuck. Accordingly, by relieving the outward pressure exerted by the expansion units (particularly the core relief feature 82), the core distal end may not be easily deformed as the rolled material 3 is depleted in use, and the remaining rolled material on the winding core 2 is not damaged, torn, or otherwise disturbed as the final meters of rolled material 3 is used by the machine. For example, embodiments of the present disclosure describe expansion unit features 37 having, for example, features 37 that provide an improved insertion of the shaft into the core, which may mitigate and/or eliminate radial overloading of the cores. The shape of the core relief features 82 and 83 may be sloped, scalloped, curved, undular, include perturbations or arranged in an arcuate profile. The shapes of the core relief features 82 and 83 may be similar or dissimilar to each other.

FIG. 23 includes one or more spacer members arranged on a portion of the support portion providing extended lip features 81 arranged on the central shaft 5 of the torque activated chuck 80. The extended lip features 81 are arranged having an arcuate profile and are arranged substantially concentric to the support cage 14. The extended lip features 81 may be arranged with any suitable thickness creating a gap between rolled material 3 (when disposed on the torque activated chuck 80) and a core 2, which may be determined partially by a thickness, size, and shape of a core 2 (of FIG. 12) and the rolled material 3. Though the extended lip features 81 are illustrated with an arcuate profile, the extended lip features 81 may include any suitable profile or cross-sectional shape creating a gap between the rolled material 3, the winding core 2 on which the rolled material 3 is loaded, and any surface disposed on the torque activated chuck 80.

Figure 24:
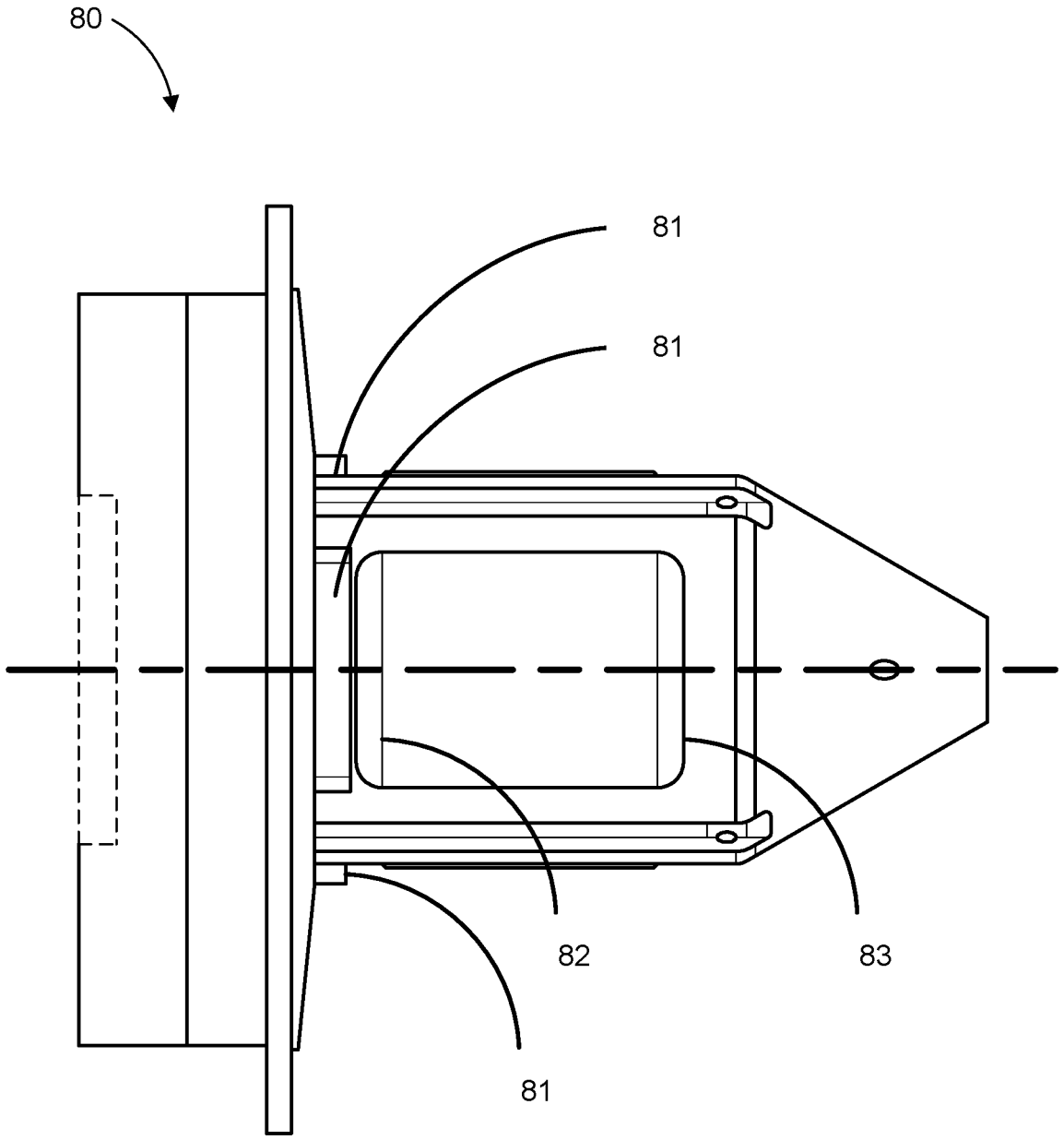
FIG. 24 depicts an isometric perspective view of a mechanical torque activated chuck assembly in accordance with embodiments.

FIG. 24 illustrates a side view of the torque activated chuck 80 illustrating the features 82 and 83 and the extended lip features 81.

Figure 25:
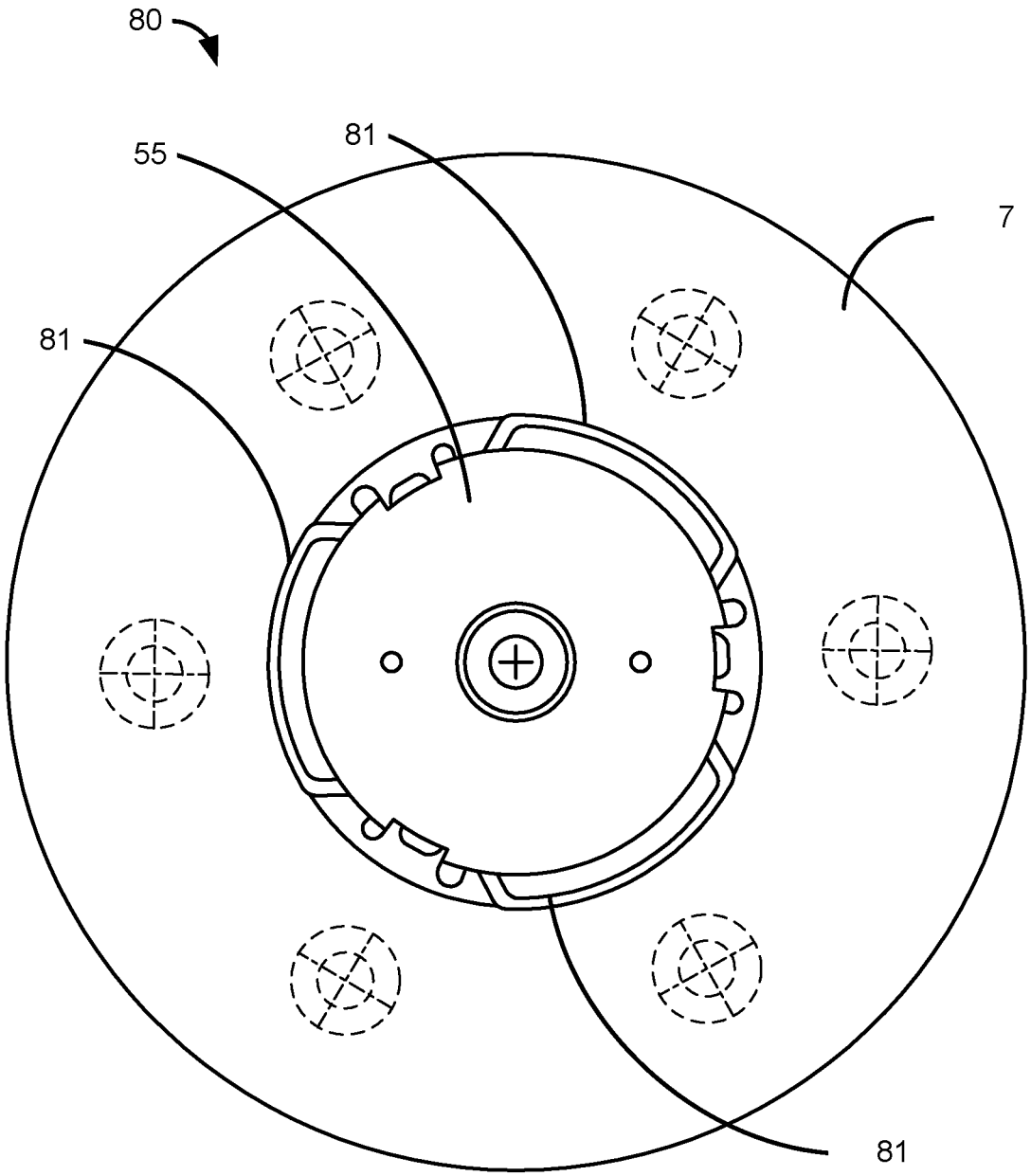
FIG. 25 is another view of the chuck of FIG. 24 with an ejection flange in the fully advanced position in accordance with the present disclosure.

FIG. 25 illustrates a front view of the torque activated chuck 80 showing the closing plate 55 and the extended lip features 81 disposed on the central shaft 5.

Figure 26:
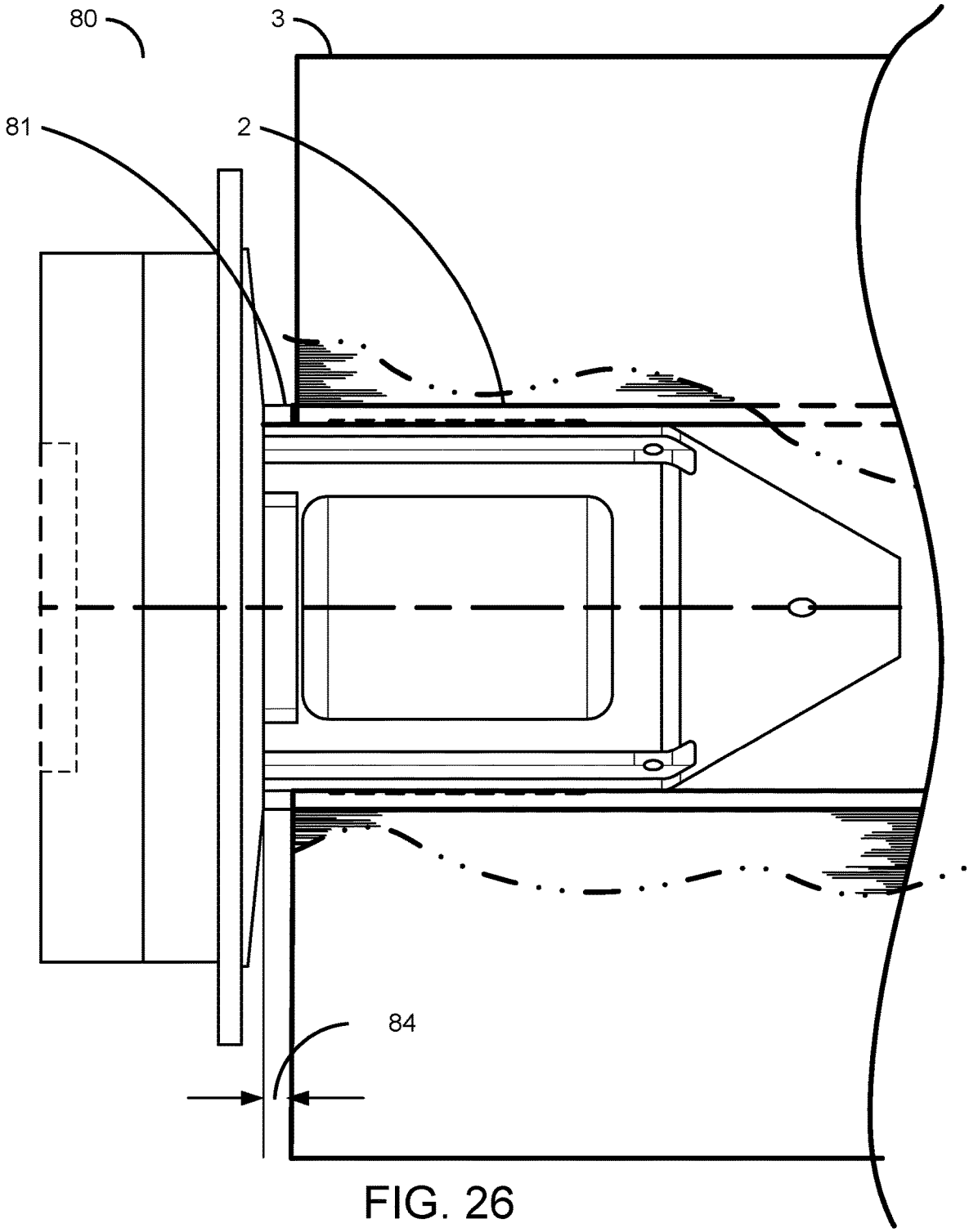
FIG. 26 depicts another view of a central shaft of a torque activated chuck in the retracted position engaging a core in accordance with the present disclosure

FIG. 26 illustrates a cross-sectional view of embodiments of a torque activated chuck 80 engaging a core 2 with wound material 3. The extended lip features 81 are sized and shaped to contact a distal surface of the core 2 while reducing or impeding the material 3 from contacting the torque activated chuck 80. In this regard the extended lip features 81 form a gap 84. The gap 84 may be partially defined by the extended lip features 81, the core 2, and the material 3. The gap 84 reduces or prevents contact between the material 3 and the torque activated chuck 80.

Figure 27B:
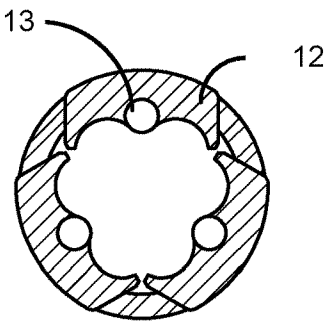
FIGS. 27B, 28B, and 29B are sectional views of parts of support spindles according to embodiments, having different engagement diameters with the winding core and being in a completely radially expanded configuration in accordance with the present disclosure.
Figure 27A:
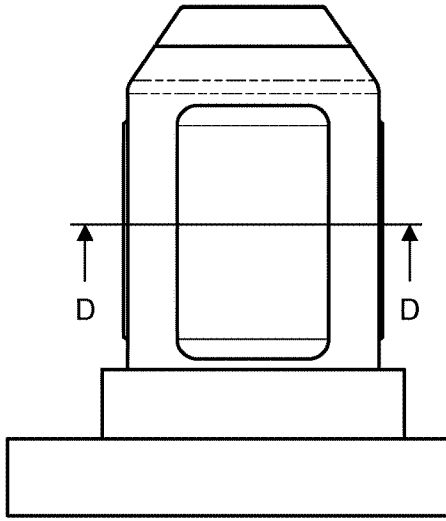
FIGS. 27A, 28A, and 29A are front views of support spindle portions according to embodiments, having different engagement diameters with the winding core and being in a completely radially expanded configuration in accordance with the present disclosure.
Figure 28B:
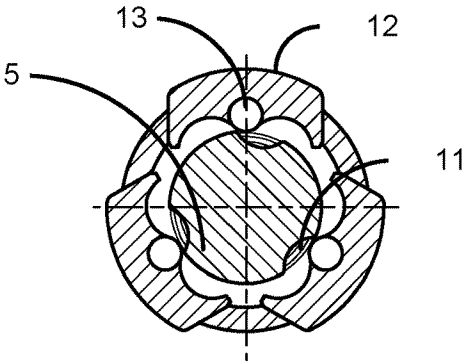
Figure 28A:
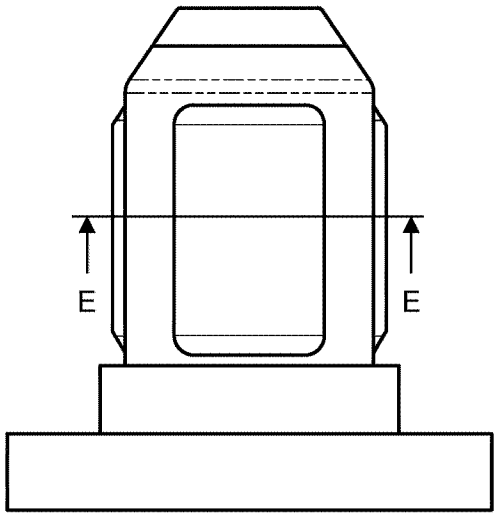
Figure 29B:
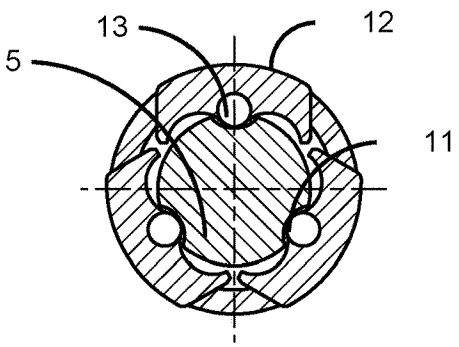
Figure 29A:
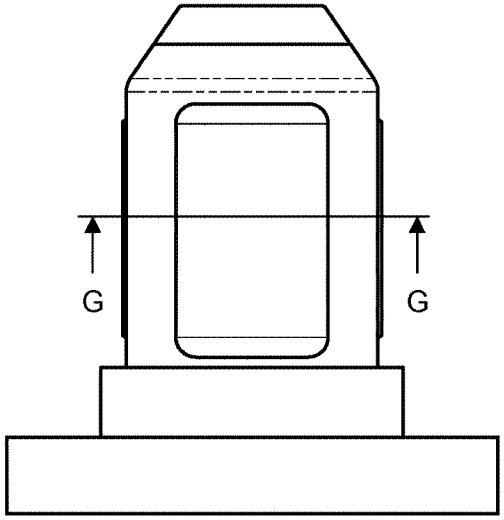

FIGS. 27A, 28A, and 29A are front views of support spindle portions according to embodiments, having different engagement diameters with the winding core.

FIGS. 27B, 28B, and 29B are sectional views of parts of support spindles according to embodiments, having different engagement diameters.

FIG. 27B illustrates a cut-away view along the line D in FIG. 27A. FIG. 27B includes an arrangement of the follower members 13 and the expansion units 12.

FIG. 28B illustrates the torque activated chuck 1 in an expanded position. In this regard, the central shaft 5 is shown with the follower members 13 moved relative to the cam seats 11. The rotation of the central shaft urges the follower members to rotate and travel in the cam seats 11. The shape of the cam seats 11 urges the follower members 13 outwardly in a radial direction from the axis of rotation 6 (of FIG. 1).

FIG. 28B illustrates the torque activated chuck 1 in a retracted position. In this regard, the rotation of the central shaft 5 has substantially slowed and the follower members 13 rotate or move in the cam seats 11. The shape of the cam seats 11 draws the follower members 13 closer to the center of rotation of the assembly. As the follower members 13 retract, the expansion units 12 are allowed to retract towards the axis of rotation 6 of the torque activated chuck 1.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A chuck comprising:

a central shaft defining an axis of rotation;

a cam seat defined by the central shaft;

a support portion partially defining a first cavity having a first orifice at a distal end of the support portion, the first orifice operative to engage the central shaft;

a spacer member arranged on a portion of the support portion, wherein the spacer member is configured to contact a distal surface of a core of a roll of material, wherein the spacer member is operative to impede motion of the core of the roll of material along the axis of rotation, and wherein the spacer member is disposed on an outer surface of the support portion;

a second orifice defined by the support portion, wherein the portion is located between the distal end of the support portion and the second orifice, wherein the portion is located at a predetermined non-zero distance from the distal end of the support portion, and wherein a length of the spacer member is equivalent to a width of the second orifice;

an expansion portion arranged in the second orifice such that the expansion portion is operative to move radially in the second orifice with respect to the axis of rotation; and a follower member arranged in the cam seat.

2. The chuck of claim 1, further comprising a third orifice at a proximal end of the support portion.

3. The chuck of claim 1, wherein the expansion portion has an arcuate profile comprising a core relief feature.

4. The chuck of claim 1, wherein the chuck is a torque activated chuck, such that when torque is applied to the chuck the expansion portion is urged to move radially outward with respect to the axis of rotation.

5. The chuck of claim 1, wherein the follower member has a cylindrical shape.

6. The chuck of claim 1, wherein the expansion portion is urged radially outward when the central shaft rotates about the axis of rotation inducing relative motion between the expansion portion and the central shaft.

7. The chuck of claim 1, further comprising a thrust bearing arranged in the support portion.

8. The chuck of claim 1, wherein the expansion portion has a first region having a first profile at a distal end of the expansion portion.

9. The chuck of claim 8, wherein the expansion portion has a second region having a first profile at a proximal end of the expansion portion.

10. The chuck of claim 1, wherein the distal end of the support portion comprises a cylindrical portion, and wherein the spacer member is concentric to the cylindrical portion.

11. A chuck comprising:

a central shaft defining an axis of rotation;

a cam seat defined by the central shaft;

a support portion partially defining a first cavity having a first orifice at a distal end of the support portion, the first orifice operative to engage the central shaft;

a spacer member arranged on a portion of the support portion, the spacer member operative to impede motion of a core of a roll of material along the axis of rotation, wherein the spacer member is disposed on an outer surface of the support portion;

a second orifice defined by the support portion, wherein the portion is located between the distal end of the support portion and the second orifice, wherein the portion is located at a predetermined non-zero distance from the distal end of the support portion, and wherein a length of the spacer member is equivalent to a width of the second orifice;

an expansion portion arranged in the second orifice such that the expansion portion is operative to move radially in the second orifice with respect to the axis of rotation, wherein the expansion portion has an arcuate profile; and a follower member arranged in the cam seat.

12. The chuck of claim 11, further comprising a third orifice at a proximal end of the support portion.

13. The chuck of claim 11, wherein the chuck is a torque activated chuck, such that when torque is applied to the chuck the expansion portion is urged to move radially outward with respect to the axis of rotation.

14. The chuck of claim 11, wherein the follower member has a cylindrical shape.

15. The chuck of claim 11, wherein the expansion portion is urged radially outward when the central shaft rotates about the axis of rotation inducing relative motion between the expansion portion and the central shaft.

16. The chuck of claim 11, further comprising a connection portion arranged coaxially with the central shaft at a distal end of the central shaft.

17. The chuck of claim 11, further comprising a thrust bearing arranged in the support portion.

18. A chuck comprising:

a central shaft defining an axis of rotation;

a cam seat defined by the central shaft;

a support portion partially defining a first cavity having a first orifice at a distal end of the support portion, the first orifice operative to engage the central shaft;

a spacer member arranged on a portion of the support portion, the spacer member operative to impede motion of a core of a roll of material along the axis of rotation, wherein the spacer member is disposed on an outer surface of the support portion;

a second orifice defined by the support portion, wherein the portion is located between the distal end of the support portion and the second orifice, wherein the portion is located at a predetermined non-zero distance from the distal end of the support portion, and wherein a length of the spacer member is equivalent to a width of the second orifice;

an expansion portion arranged in the second orifice such that the expansion portion is operative to move radially in the second orifice with respect to the axis of rotation, wherein the expansion portion has a first region having a first profile at a distal end of the expansion portion; and a follower member arranged in the cam seat.

19. The chuck of claim 18, wherein the expansion portion is urged radially outward when the central shaft rotates about the axis of rotation inducing relative motion between the expansion portion and the central shaft.

* * * * *